US006979139B2

(12) United States Patent
Hine et al.

(10) Patent No.: US 6,979,139 B2
(45) Date of Patent: Dec. 27, 2005

(54) PRINTING APPARATUS, PRINTING METHOD, AND PROGRAM THEREFOR

(75) Inventors: Yoichi Hine, Tokyo (JP); Takanobu Kameda, Tokyo (JP); Toshinori Nojima, Tokyo (JP)

(73) Assignee: King Jim Co., Ltd., Tokyo (JP)

( * ) Notice: Subject to any disclaimer, the term of this patent is extended or adjusted under 35 U.S.C. 154(b) by 0 days.

(21) Appl. No.: 10/873,876

(22) Filed: Jun. 22, 2004

(65) Prior Publication Data

US 2004/0265027 A1 Dec. 30, 2004

(30) Foreign Application Priority Data

Jun. 27, 2003 (JP) ..... 2003-185342

(51) Int. Cl.[7] ..... B41J 11/44
(52) U.S. Cl. ..... 400/76; 400/70; 400/615.2
(58) Field of Search ..... 400/615.2, 76, 400/70, 61, 207, 208; 347/14, 19

(56) References Cited

U.S. PATENT DOCUMENTS

| | | | | |
|---|---|---|---|---|
| 5,562,353 | A * | 10/1996 | Handa et al. | 400/615.2 |
| 5,680,520 | A * | 10/1997 | Watanabe et al. | 345/471 |
| 5,920,684 | A * | 7/1999 | Hastings et al. | 358/1.13 |
| 5,926,618 | A * | 7/1999 | Watanabe et al. | 358/1.11 |
| 6,338,583 | B1 * | 1/2002 | Tanabe et al. | 400/63 |
| 6,375,306 | B1 * | 4/2002 | Tsukagoshi | 347/40 |
| 6,666,593 | B2 * | 12/2003 | Akaiwa | 400/61 |
| 2002/0197090 | A1 * | 12/2002 | Akaiwa | 400/76 |

FOREIGN PATENT DOCUMENTS

| | | |
|---|---|---|
| JP | 61-011277 | 1/1986 |
| JP | 62-041066 | 2/1987 |
| JP | 01-113260 | 5/1989 |
| JP | 02-064661 | 3/1990 |
| JP | 02-201631 | 8/1990 |
| JP | 03-067824 | 3/1991 |
| JP | 03-087278 | 4/1991 |
| JP | 04-338049 | 11/1992 |
| JP | 05-18853 | 3/1993 |
| JP | 06-024107 | 2/1994 |
| JP | 3034339 | 2/2000 |
| JP | 3378622 | 12/2002 |

* cited by examiner

*Primary Examiner*—Minh Chau
(74) *Attorney, Agent, or Firm*—Alston & Bird LLP

(57) ABSTRACT

A printing apparatus which enables a user to verify a tape information at any selected time, including immediately before printing, thereby optimizing printing processes, and also prevents performing printing contrary to the intentions of the user, caused by, for example, cartridge mounting mistakes. Further, a technology for controlling the printing apparatus is also provided. A printing apparatus 1 for printing a printing data on a tape is provided with a tape identification sensor 142 for detecting the width of a tape mounted in the printing apparatus 1, an operating portion 11 for setting a tape width setting value that is reflected in the printing data, and a display 306 that outputs the tape width information in a state that is recognizable to a user before printing commences, and after the tape width information is output, the operating portion 11 accepts a user's operation for designating execution of printing that reflects the tape width setting value or cancellation of the printing designation.

16 Claims, 14 Drawing Sheets

PRINTING APPARATUS, PRINTING METHOD, AND PROGRAM THEREFOR

BACKGROUND OF THE INVENTION

1. Field of the Invention

The present invention relates to a printing technology. In particular, the present invention relates to a printing apparatus that prints created printing data on a printing medium such as a tape, a printing method, and a program for the printing apparatus.

2. Description of the Related Art

A printing apparatus disclosed in JP 3378622 B, for example, is known as this type of printing apparatus.

This printing apparatus is configured by a data creating device for creating printing data, and a separate tape printer that is connected to the data creating device through a connecting line. Further, when printing the printing data created by the data creating device, the printing data is transferred to the tape printer, and printing is performed to a tape within a tape cassette (hereinafter referred to as tape cartridge) mounted in the tape printer.

Furthermore, in recent years, various kinds of tapes have been provided in order to satisfy the various needs of users. More specifically, a variety of tapes are prepared such as tapes having different widths, and transfer tapes for mirror image character printing, and a user selects, as needed, a tape cartridge that houses a tape that conforms to the user's printing objective, mounts the tape cartridge in the tape printer, and performs printing.

The tapes, which are printing media, are housed within the tape cartridges, as described above, and it is difficult to identify the tapes from one another from the appearance of the tape cartridges. Further, there are cases, during printing, where the width or the type of the tape used previously differs from that of the tape desired to be used next. In addition, there are cases where the width or the type of a tape suited to data created previously differs from that of a tape currently mounted in the printing apparatus when the previously created data is read out and used. Thus, in some cases, printing is performed on a tape that is not intended to be used by the user, and, therefore, improvements are sought in respect of handling of the tapes and the printing apparatus.

Conventional printing apparatuses transfer the information relating to the tape cartridge mounted in a tape printer to the data creating device, and further, check the transferred cartridge information with cartridge information set in the printing data at the time of printing by using the data creating device. An error message is displayed if the transferred cartridge information and the set cartridge information are not identical, thereby to prevent printing with a wrong data cartridge mounted. Furthermore, when they are identical, the printing processing is performed automatically, without the display of the error message.

However, the earnest research made by the inventors of the present invention has led to the discovery of various points need to be improved in conventional printing apparatuses.

First, one point deserving attention is the fact that default settings (for example, the tape width) are read-in automatically at the time of creation of the printing data, and the default settings will be reflected in the printing data unless the user intentionally changes the default settings. Accordingly, work for verifying the default settings is required each time when a printing data is created in order to perform printing appropriately.

Further, verification of the default settings is a difficult operation for users who are not accustomed to the operation, and a majority of the users implement printing without verifying the default settings. When the default settings and the information on the mounted tape cartridge happen to coincide with each other contrary to the intentions of the user, printing is executed in a printing form that is contrary to the intentions of the user.

That is, in conventional printing apparatuses, when the cartridge information sent from the tape printer is identical to the settings used at the time of creation of the printing data, it is regarded that, in terms of controlling, the proper operations having been made, regardless of the intentions of the user, and printing is thus carried out in a printing form that is contrary to the intentions of the user, as described above.

SUMMARY OF THE INVENTION

The present invention has been made in consideration of this technical background. An object of the present invention is to provide a printing apparatus which enables a user to verify the tape information at any desired time, including immediately before printing, regardless of whether or not a tape in a tape cartridge conforms to settings, thus making the printing apparatus suitable for printing processing, and also capable of preventing printing that is contrary to the intentions of the user, such as cartridge mounting mistakes. It is another object of the present invention to provide a control technology for the printing apparatus.

In order to achieve the above technical objects, the present invention provides the following configuration.

That is, the present invention is a printing apparatus for printing a printing data on a tape, comprising:

- a mounted tape information acquiring portion for acquiring a mounted tape information relating to a tape mounted in the printing apparatus;
- an editing tape information setting portion for setting an editing tape information to be edited at the time of editing the printing data;
- a tape information outputting portion for outputting the mounted tape information and the editing tape information in a state to be recognized by a user before commencing printing; and
- designation operation accepting means that, after the tape information is output, accepts a user's designation operation for execution of printing that reflects the editing tape information or cancellation of the printing designation.

According to the printing apparatus of this configuration, the mounted tape information and the editing tape information are output in a state to be recognized by the user at any desired time before commencing printing. Further, the user's designation operation for performing printing that reflects the editing tape information or for canceling the printing designation is accepted after the mounted tape information and the editing tape information are output. This designation operation determines whether or not to perform printing that reflects the editing tape information.

It should be noted that the term "mounted tape information" as used here means, for example, the information that can specify the tape in the tape cartridge that is mounted in the printing apparatus. It becomes possible to specify the tape and to distinguish the tape from other tapes by providing the mounted tape information to the tape cartridge, for example. Further, the term "mounted tape information acquisition" corresponds to control operations for grasping the mounted tape information by processes such as, for example, referencing to or reading the mounted tape information. Furthermore, the term "editing tape information" means the data of the tape width or the like which is used at the time of editing, and which is reflected in control during printing. The editing tape information is reflected in the printing data during printing of the printing data. Still further, the term "tape information output" corresponds to control operations for providing the tape information so that the user can eventually identify the tape information by, for example, image or sound.

With this configuration, the tape information (such as the tape width and length) is verifiably output to the user at any desired time before printing commences. Accordingly, even users who are inexperienced in operations can grasp, based on the tape information and before printing begins, whether or not a suitable printing is to be performed. Further, the tape information can be verified regardless of whether or not there are user operations, and, therefore, the printing by using an incorrect tape can be suppressed, for example, when the user intends to use a 12 mm width tape, actually a 6 mm width tape is mounted. Thus, with this printing apparatus, the intentions of the user can be easily and accurately reflected in control of the printing apparatus, without any complex operations.

Further, according to the present invention, there is provided the following configuration.

That is, a printing apparatus for printing a printing data on a tape, comprising:

a mounted tape information acquiring portion for acquiring a mounted tape information relating to a tape mounted in the printing apparatus;

an editing tape information setting portion for setting an editing tape information to be edited at the time of editing the printing data;

a tape information outputting portion for outputting the mounted tape information and the editing tape information in a state to be recognized by a user; and a replacement verification information outputting portion that, after the tape information is output, outputs in a state to be recognized by the user a replacement verification information for requesting the user to verify as to whether or not to replace the tape in the printing apparatus according to the editing tape information.

According to the printing apparatus having this configuration, the mounted tape information and the editing tape information are output regardless of whether or not the mounted tape information coincides with the editing tape information. Further, after both types of tape information are displayed, the replacement verification information is output in the state to be recognized by the user for determining whether or not to replace the tape in the printing apparatus to conform to the editing tape information.

Accordingly, the user can determine whether or not to replace the tape in the printing apparatus while comparing the mounted tape information and the editing tape information that are visibly output to the user. Therefore, even users who are unfamiliar with the operation can determine as to whether or not a suitable printing processing is to be executed by verifying both types of information.

Further, according to the present invention, there is provided the following configuration.

That is, a printing apparatus for printing a printing data on a tape, comprising:

a mounted tape information acquiring portion for acquiring a mounted tape information relating to a tape mounted in the printing apparatus;

an editing tape information setting portion for setting an editing tape information to be edited at the time of editing the printing data;

a tape information outputting portion for outputting the mounted tape information and the editing tape information in a state to be recognized by a user; and a setting verification information outputting portion that, after the tape information is output, outputs in a state to be recognized by the user a setting verification information for requesting the user to verify as to whether or not to set the editing tape information according to the mounted tape information.

According to this printing apparatus, the mounted tape information and the editing tape information are output regardless of whether or not the mounted tape information coincides with the editing tape information. Further, after both types of tape information are displayed, the setting verification information for obtaining a user verification is visibly output to the user for determining whether or not to set the editing tape information to conform to the tape information mounted in the printing apparatus.

Accordingly, the user can determine whether or not to set the editing tape information to conform to the tape mounted in the printing apparatus, regardless of whether the mounted tape information coincides with the editing tape information, while referring to the two types of information. Therefore, even users who are unfamiliar with the operation can determine as to whether or not a suitable printing processing is to be executed by verifying both types of information. As a result, it becomes possible for the user to output a simple, accurate instruction for controlling the printing apparatus without the need for complex operations.

The printing apparatus according to the present invention may also be configured to further include:

a printing data storing portion for storing a printing data together with the editing tape information associated with the printing data; and a printing data read-out portion for reading out the printing data taken as an editing object from the printing data storing portion and the editing tape information associated with the printing data, wherein:

the tape information outputting portion outputs the tape information in a state to be recognized by the user when the printing data read-out portion reads out a selected printing data, from among the printing data stored in the printing data storing portion, as the editing object.

According to this configuration, a printing data storing portion is provided for storing the printing data and the editing tape information that is appended to the printing data. Further, the printing data and the editing tape information appended to the printing data are suitably readable from the printing data storing portion. The tape information outputting portion receives a readout of the printing data and the editing data, and outputs the editing data and the mounted tape information in a recognizable state to the user, regardless of whether or not the two types of data coincide with each other. That is, the tape information, including the editing tape information, is recognizably output to the user when the editing tape information appended to the printing data is read out from the printing data storing portion.

The printing apparatus according to the present invention may also be configured to further include:

an editing tape information altering portion for altering the editing tape information to be edited at the time of editing the printing data, wherein:

the tape information outputting portion outputs the tape information in a state to be recognized by a user when the editing tape information altering portion alters the editing information to be edited.

According to this configuration, the editing tape information altering portion is provided for altering the editing tape information to be edited to conform to the mounted tape information. Further, the tape information outputting portion outputs the mounted tape information and the existing editing tape information when the editing tape information altering portion is going to alter the editing tape information. That is, the mounted tape information and the existing editing tape information are provided to the user before altering the editing tape information. Thus, the user can grasp whether or not the altering process is suitable before altering the editing tape information by using the editing tape information altering portion.

The printing apparatus according to the present invention may also be configured to further include:

a mounted tape information reacquiring portion for reacquiring a mounted tape information relating to a newly mounted tape when the tape mounted in the printing apparatus is replaced, wherein:

the tape information outputting portion outputs the mounted tape information relating to the newly mounted tape as a tape information in a state to be recognized by a user when the mounted tape information reacquiring portion acquires the mounted tape information relating to the newly mounted tape.

According to this configuration, a mounted tape information reacquiring portion is provided for acquiring a mounted tape information relating to a newly mounted tape. Further, after receiving the mounted tape information acquired relating to the newly mounted tape, the tape information output portion recognizably outputs the mounted tape information relating to the newly mounted tape to the user. It, therefore, becomes possible for the user to grasp the tape information of the newly mounted tape, even during the exchanging of tapes.

The printing apparatus according to the present invention may also have a configuration in which the tape information outputting portion outputs the tape information in a state to be recognized by a user before printing commences.

According to this configuration, the mounted tape information relating to the tape mounted in the printing apparatus and the editing tape information for editing are recognizably output to the user before printing commences.

The printing apparatus according to the present invention may also have a configuration in which:

the mounted tape information acquiring portion acquires a width information of a tape mounted in the printing apparatus as a mounted tape width information;

the editing tape information setting portion sets a width information of the editing tape as an editing tape width information; and the tape information outputting portion outputs the mounted tape width information together with the editing tape width information.

According to this configuration, the tape information outputting portion outputs the width information of the tape that is mounted in the printing apparatus as the mounted tape information. Further, a tape width information at the editing side which has been set is also output as an editing tape information. Accordingly, the user can compare, for example, the width of the tape mounted in the printing apparatus and the tape width to be reflected in the printing data before printing commences, regardless of whether or not they coincide with each other. It, therefore, becomes possible to clearly grasp, before printing commences, whether or not the suitable printing processing is to be performed.

The printing apparatus according to the present invention may also be configured to further include an editing tape width updating means that updates the editing tape width information to a value corresponding to the mounted tape width information in the case where the mounted tape width information and the editing tape width information differ.

According to this configuration, an updating function that updates the value of the editing side tape information, that is the value of the width information of the editing tape, to conform to the width of the tape that is mounted in the printing apparatus when the width of the tape mounted in the printing apparatus does not conform to the width of the tape to be edited.

The printing apparatus according to the present invention may also be configured to further include compound printing means that prints n number of printing data that are lined up in a width direction of the tape mounted in the printing apparatus, in the case where a value A of the mounted tape width information and a value B of the editing tape width information satisfy a relationship $A=n\times B$ (where n is an integer equal to or greater than 2).

According to this configuration, in the case where the relationship between the width A of the tape mounted in the printing apparatus and the tape width B that is set in the editing tape width information used in editing the printing data satisfies the equation $A=n\times B$ (where n is an integer equal to or greater than 2), that is, in the case where a wide tape is mounted in the printing apparatus, n number of printing data are printed lined up in the width direction of the tape. The printing data is therefore printed in n columns with respect to the width B tape.

The printing apparatus according to the present invention may also be configured to further include divided printing means that prints the printing data lined up in a longitudinal direction of the tape having the width information A, the printing data being divided into n numbers in a width direction of the tape having the width information B, thereby to configure a tape with a quasi-width information of B when n number of the width information As are lined up in the width direction thereof, in the case where a value A of the mounted tape width information and a value B of the editing tape width information satisfy a relationship $B=n\times A$ (where n is an integer equal to or greater than 2).

According to this configuration, in the case where the width B of the editing side tape is wider with respect to the width A of the tape mounted in the printing apparatus, the printing data corresponding to the width B tape is divided into n numbers in the width direction of the printing data, and each of the divided printing data are printed lined up in the longitudinal direction of the width A tape. Accordingly, the printing data can be displayed in a normal size on the tape if the tape of the width A is cut at suitable positions, and the n number of cut portions are lined up in the width direction of the tape, forming a tape of quasi-width B tape.

The printing apparatus according to the present invention may also have a configuration in which:

the mounted tape information acquiring portion acquires information relating to whether or not a tape used for transfer is mounted in the printing apparatus; and the tape information outputting portion outputs the mounted tape information indicating that the transfer tape is mounted when the transfer tape is mounted.

According to this configuration, in the case where a transfer tape is mounted in the printing apparatus, the tape information is output signifying that the transfer tape is mounted, regardless of whether or not a mirror image printing designation is made.

Further, according to the present invention, in order to achieve the above technical objects, there is provided the following printing method.

That is, a printing method for printing a printing data on a tape comprising:

acquiring a mounted tape information that relates to a tape mounted in a printing apparatus, and an editing tape information to be edited at the time of editing the printing data;

outputting the acquired mounted tape information and the editing tape information in a state to be recognized by a user before printing commences; and after the tape information is output, accepting a user's designation operation for either execution of printing that reflects the editing tape information or cancellation of the printing designation.

Further, according to the present invention, a printing method for printing a printing data on a tape may comprise:

acquiring a mounted tape information that relates to a tape mounted in a printing apparatus, and an editing tape information to be edited at the time of editing the printing data;

outputting the acquired mounted tape information and the editing tape information in a state to be recognized by a user; and after the tape information is output, requesting the user for verification of whether or not to replace the tape in the printing apparatus according to the editing tape information.

Further, according to the present invention, a printing method for printing a printing data on a tape may comprise:

acquiring a mounted tape information that relates to a tape mounted in a printing apparatus, and an editing tape information to be edited at the time of editing the printing data;

outputting the acquired mounted tape information and the editing tape information in a state to be recognized by a user; and after the tape information is output, requesting the user for verification of whether or not to set the editing tape information according to the mounted tape information.

The printing method may further include:

storing the printing data together with the editing tape information that is associated with the printing data; and outputting the tape information in a state to be recognized by a user any selected arbitrary printing data from among the stored printing data and the editing tape information associated with this printing data are read out as editing objects.

The printing method may further include outputting the tape information in a state to be recognized by a user before changing the editing information to be edited at the time of editing the printing data.

The printing method may further include:

acquiring a mounted tape information relating to a newly mounted tape when the tape mounted in the printing apparatus is replaced; and outputting the mounted tape information relating to the newly mounted tape in a state to be recognized by a user.

It is also preferable that the printing method further includes outputting the mounted tape information in a state to be recognized by a user before printing commences.

It is also preferable that the printing method further includes:

acquiring a width information of the tape mounted in the printing apparatus as a mounted tape width information when acquiring the mounted tape information;

acquiring a width information of the editing tape as an editing tape width information when acquiring the editing tape information; and outputting the mounted tape width information and the editing tape width information when the mounted tape information and the editing tape information are output.

It is also possible that the printing method further includes updating the editing tape width information to a value corresponding to the mounted tape width information in the case where the mounted tape width information and the editing tape width information differ.

The printing method may further include printing the n number of printing data, lined up in a width direction of the tape mounted in the printing apparatus, in the case where a value A of the mounted tape width information and a value B of the editing tape width information satisfy a relationship $A=n\times B$ (where n is an integer equal to or greater than 2).

Conversely, the printing method may include printing the printing data lined up in a longitudinal direction of the tape of the width information of A, the printing data being divided into n numbers in a width direction of the tape of the width information of B, thereby to configure a tape with a quasi-width information of B when n number of the width information As are lined up in the width direction of the tape, in the case where a value A of the mounted tape width information and a value B of the editing tape width information satisfy a relationship $B=n\times A$ (where n is an integer equal to or greater than 2).

The printing method may further include:

acquiring information relating to whether or not a tape used for transfer is mounted in the printing apparatus when a mounted tape information is acquired; and outputting the mounted tape information, indicating that the transfer tape is mounted, as a mounted tape information when the transfer tape is mounted.

Further, according to the present invention, in order to achieve the above technical objects, there is provided the following program.

That is, a program for a control device for controlling a printing apparatus for printing a printing data on a tape, the program causing the control device to implement:

a mounted tape information acquiring function for acquiring a mounted tape information relating to a tape mounted in the printing apparatus;

an editing tape information setting function for setting an editing tape information to be edited at the time of editing the printing data;

a tape information outputting function for outputting the mounted tape information and the editing tape information in a state to be recognized by a user before printing commences; and a designation operation accepting function that, after the tape information is output, accepts a user's designation operation for either execution of printing that reflects the editing tape information or cancellation of the printing designation.

Further, according to the present invention, a program for a control device for controlling a printing apparatus for printing a printing data on a tape, may cause the control device to implement:

a mounted tape information acquiring function for acquiring a mounted tape information relating to a tape mounted in the printing apparatus;

an editing tape information setting function for setting an editing tape information to be edited at the time of editing the printing data is edited;

a tape information outputting function for outputting the mounted tape information and the editing tape information in a state to be recognized by a user; and a replacement verification information outputting function that, after the tape information is output, outputs in a state to be recognized by the user a replacement verification information for requesting the user for verification of whether or not to replace the tape in the printing apparatus according to the editing tape information.

Further, according to the present invention, a program for a control device for controlling a printing apparatus for printing a printing data on a tape, may cause the control device to implement:

a mounted tape information acquiring function for acquiring a mounted tape information relating to a tape mounted in the printing apparatus;

an editing tape information setting function for setting an editing tape information to be edited at the time of editing the printing data;

a tape information outputting function for outputting the mounted tape information and the editing tape information in a state to be recognized by a user; and a setting verification information outputting function that, after the tape information is output, outputs in a state to be recognized by the user a setting verification information for requesting the user for verification of whether or not to set the editing tape information according to the mounted tape information.

It should be noted that, in addition to distribution through recording media such as a read only memory (ROM), hard disks (HDs), magneto-optical disks (MO disks), and compact disk read only memories (CD-ROMs), it is also possible to distribute the programs through communication media such as the Internet.

Furthermore, it is possible to combine the contents of respective means for solving the problems described above without any special limitations in a scope that does not deviate from the technical concept and the objects of the present invention.

DETAILED DESCRIPTION OF THE PREFERRED EMBODIMENTS

A preferred embodiment of the present invention will be described hereinbelow with reference to the accompanying drawings.

Figure 1:
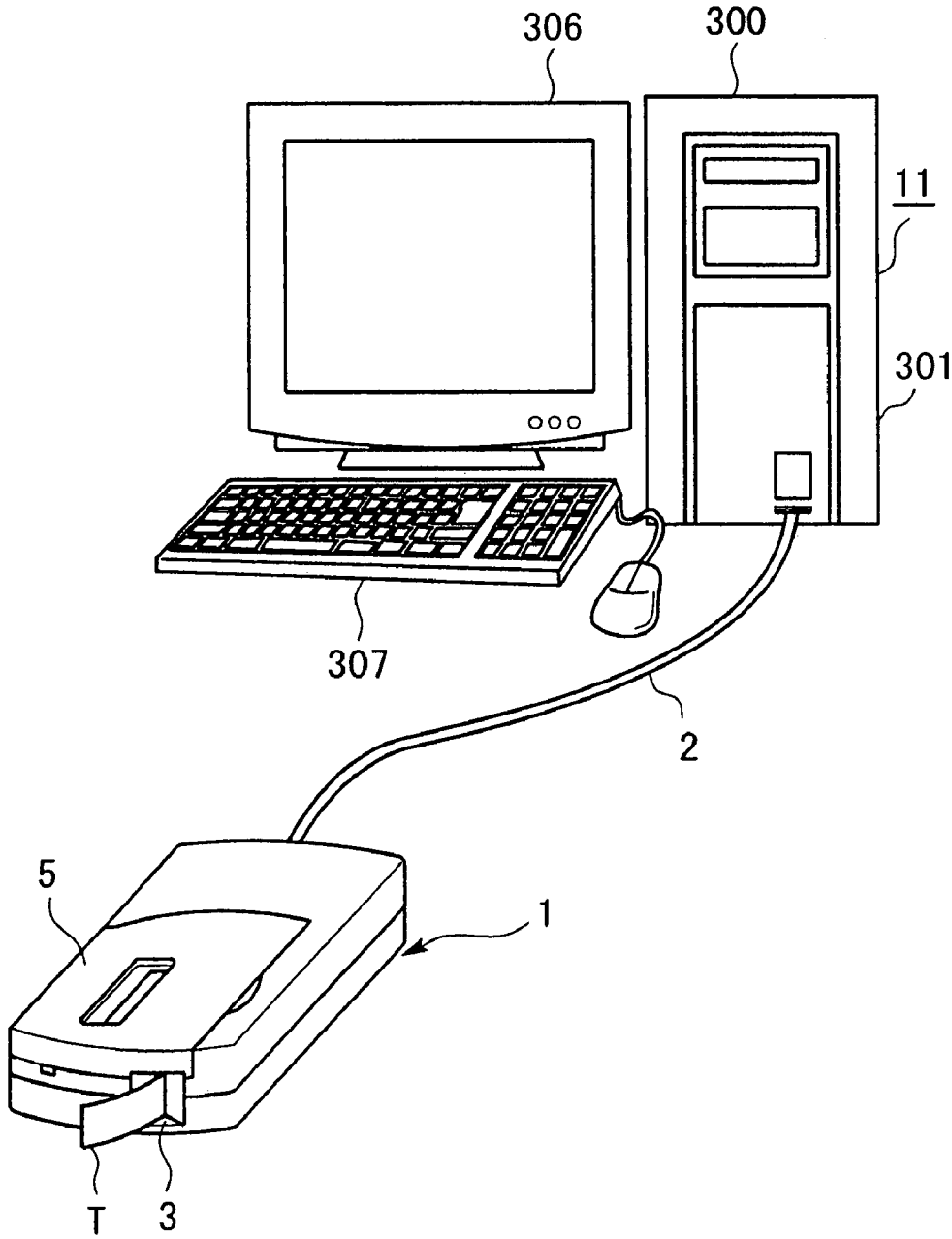
FIG. 1 is a schematic diagram of a printing apparatus according to an embodiment of the present invention, and a computer that configures a controlling portion of the printing apparatus.

A printing apparatus 1 shown in this embodiment is connected to a personal computer 300 (hereinafter referred to as the computer) as shown in FIG. 1. A printing data that is created by the computer 300 is printed on a tape in a tape cartridge mounted in the printing apparatus 1. It should be noted that a hardwired method that uses a USB cable 2 shown in FIG. 1 or the like, or a wireless method that uses infrared radiation or the like can be considered for making the connection between the printing apparatus 1 and the computer 300.

Figure 3:
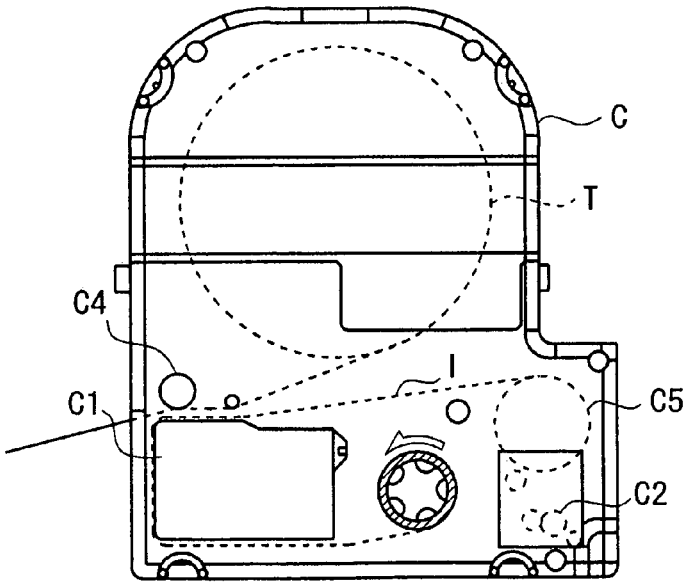
FIG. 3 is a plan view that shows a tape cartridge unit that is mounted to the printing apparatus.
Figure 4:
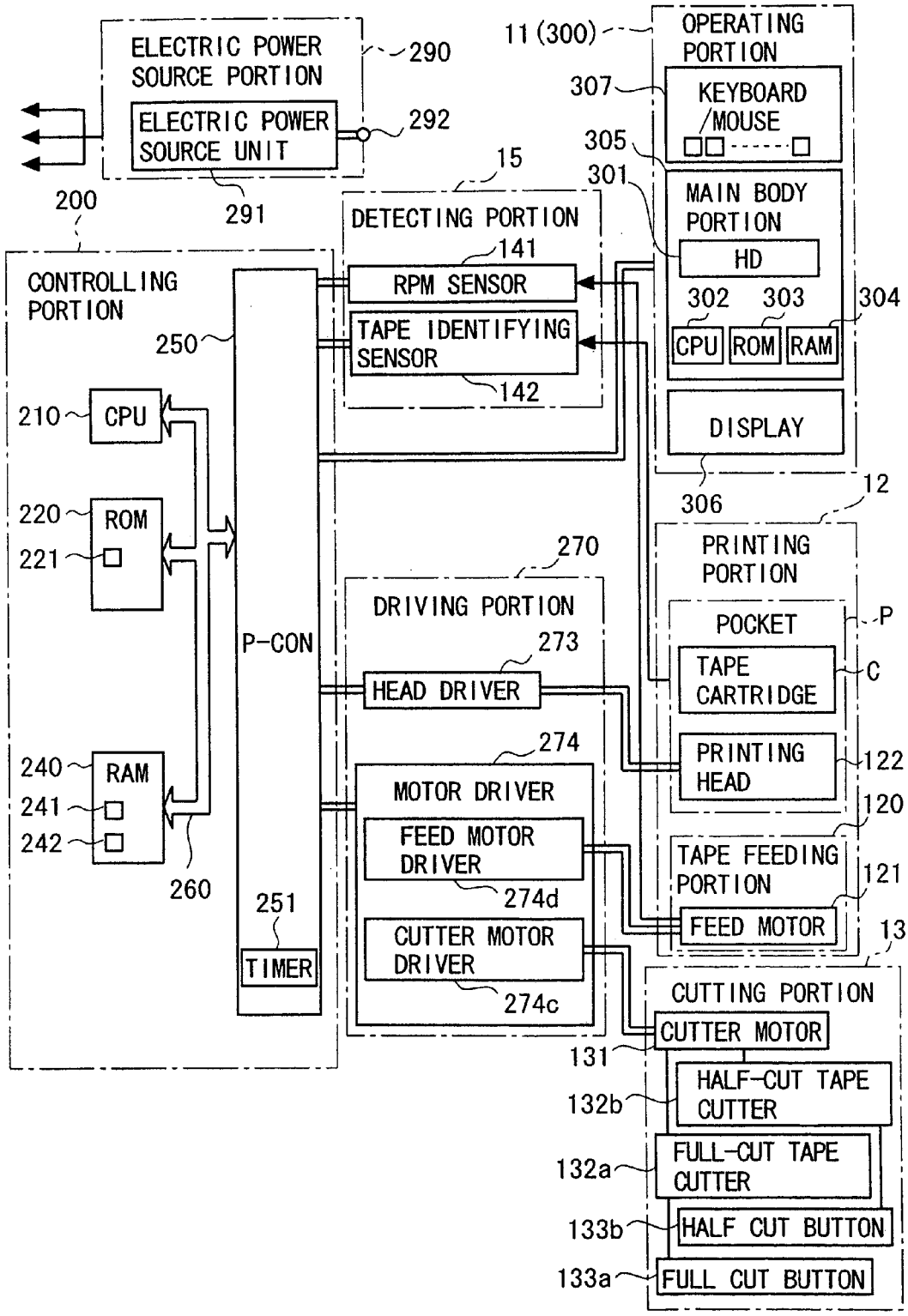
FIG. 4 is a block diagram of a control system of the printing apparatus according to the embodiment.

Further, as shown in FIG. 4, the printing apparatus 1 includes a printing portion 12 having a built-in printing head 122 and the like, a pocket P for accommodating a tape cartridge C shown in FIG. 3, a cutting portion 13 that cuts a tape T in the tape cartridge C, a driving portion 270 that drives each device in the printing portion 12 and the cutting portion 13, a detecting portion 15 that includes a tape identifying sensor 142 that identifies the tape T in the cartridge C that is mounted in the printing apparatus 1, a controlling portion 200 that analyzes the printing data transferred from the computer 300 that corresponds to an operating portion 11 of the printing apparatus 1, and causes the printing data to be reflected in a printing processing and the like, and an electric power source 290 that supplies electric power to each device in the printing apparatus 1.

Further, in this embodiment, the separately provided computer 300 functions as the operating portion 11 of the printing apparatus 1 as described above.

The computer 300 that functions as the operating portion 11 is configured by a general purpose computer 300 that includes a main body portion 305 having incorporated therein a large capacity recording device 301 such as a hard disk (HD), a central processing unit (CPU) 302, a read only memory (ROM) 303, a random access memory (RAM) 304, and the like; a display 306 that displays a variety of images; an input device 307 such as a keyboard or a mouse that is used to edit the editing tape information, which is edited at the time of the printing data; and an external read-in device (not shown) that reads data on a CD-ROM or the like into the main body portion 305.

Further, in this embodiment, a CD-ROM that stores an application program for making the computer 300 function as the operating portion 11 of the printing apparatus 1 is prepared. The application program is loaded into the computer 300 and executed, thus causing the computer 300 to function as the operating portion 11 of the printing apparatus 1.

It should be noted that the application program described above will be discussed later in the description of a printing method of the present invention.

Further, in this embodiment, each of the structures and means described in the scope of claims of the present invention are configured by the application program, devices necessary for processing the application program, and auxiliary devices such as sensors.

Next, each structure of the printing apparatus 1 is described in detail with reference to FIG. 2 to FIG. 4.

Figure 2:
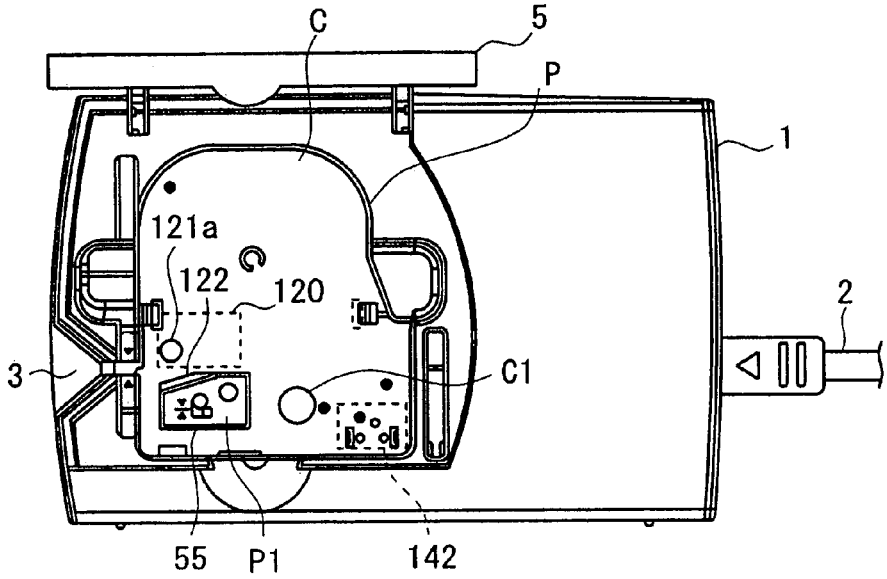
FIG. 2 is a plan view that shows a state where an openable door of the printing apparatus according to the embodiment is opened.

First, the pocket P is provided for mounting the tape cartridge C shown in FIG. 3 in the printing portion 12 (refer to FIG. 2). Further, the tape cartridge C can be mounted in the pocket P in a state where an openable cover 5 that is provided in the pocket P is opened.

Furthermore, a tape feeding portion 120 is provided in the printing portion 12. A feed motor 121 for feeding out the tape T to the printing head 122 is provided in the tape feeding portion 120 (refer to FIG. 4). After the printing head 122 effects printing on the tape T that has been fed out by the feed motor 121, the tape T is discharged to the outside of the printing apparatus 1 from a tape discharge port 3 that is provided to a side surface of the printing apparatus 1. Furthermore, a disk (not shown), in which a detection opening is formed, is fixed to abase portion of a rotation shaft 121*a* of the feed motor 121, and an rpm sensor 141 is configured by an optical sensor or the like that faces the detection opening. Further, an output from the rpm sensor 141 is sent to the controlling portion 200.

The tape cartridge C is described with reference to FIG. 3. The tape T (not shown), which has a predetermined width (for example, on the order of 4 mm to 36 mm), and an ink ribbon I (not shown) are accommodated in the tape cartridge C. Further, a through-hole C1 is formed in the tape cartridge C for receiving a head unit P1 that is provided on the pocket P.

Further, a plurality of small holes C2 are formed in a rear surface of the tape cartridge C so that the width and the like of the tape T accommodated in the tape cartridge C can be identified. A tape identifying sensor 142 that detects the presence or absence of the tape through a plurality of holes C2 formed in the tape cartridge C is correspondingly provided in the packet P. It thus becomes possible to detect the mounted tape information relating to the tape, such as the tape width or the tape type, by the tape identification sensor 142.

Further, the tape T has a three-layer structure consisting of an image receiving layer that becomes a printing surface, an adhesive material layer that is formed on the rear surface of the printing surface, and a peel off layer that is formed on the surface of the adhesive layer. The tape T and the ink ribbon I are sandwiched between the printing head 122 and a platen C4 of the tape cartridge C during printing, and travel while overlapping each other in the vicinity of the head unit P1. When the tape T reaches the printing head 122, ink from the ink ribbon I is transferred to the tape T. Printing is thus performed. Only the ink ribbon I is taken up by a take-up drum C5 in the tape cartridge C, and only the already printed tape T is discharged from the tape discharge port 3 as shown in FIG. 1.

Further, the discharged tape T can be affixed to an object by peeling the peel off layer. It should be noted that tape cartridges that accommodate not only a tape having three layers but also a tape having only one layer, such as a transfer tape for mirror image printing, can also be mounted in the printing apparatus 1.

As shown in FIG. 4, the cutting portion 13 includes a full-cut tape cutter 132*a* that cuts the tape T, a half-cut tape cutter 132*b* that cuts only the image receiving layer and the peel off layer of the tape T, cut buttons 133*a* and 133*b* enabling manual operation of the tape cutters 132*a* and 132*b*, respectively, in the case of printing on the tape in a desired length, or the like, and a cutter motor 131 that causes the tape cutters 132*a* and 132*b* to operate automatically in the case of printing on the tape in a fixed length. Further, with the printing apparatus 1, switching between automatic and manual modes can be performed according to a cut mode setting.

Accordingly, with the manual cutting, the user presses the cut button 133*a* or 133*b* provided on the printing apparatus 1 at the time when the printing is finished, thus operating the tape cutter 132*a* or 132*b* and cutting the tape T to a desired length. Further, in the case of automatic cutting, the tape T is fed by a length corresponding to a margin when printing is finished, and the cutter motor 131 operates at the same time when the tape feeding stops, thus cutting the tape T.

The detecting portion 15 includes a rpm censor 141 and the tape identifying sensor 142. It should be noted that, depending on the circumstances, other sensors such as an electric potential sensor, which is connected to an electric power source unit 291 of the electric power source 290 that supplies electric power to each portion of the printing apparatus 1 and detects fluctuations in the potential of the electric power source unit 291, may also be provided. Further, the rpm sensor 141 may be omitted in the case where the feed motor 121 of the printing portion 12 is a pulse motor.

The driving portion 270 includes a head driver 273 and a motor driver 274. The head driver 273 drives the printing head 122 of the printing portion 12. Further, the motor driver 274 includes a feed motor driver 274*d* that drives the feed motor 121 of the printing portion 12, and a cutter motor driver 274*c* that drives the cutter motor 131 of the cutting portion 13. The motor driver 274 drives each motor according to instructions from the controlling portion 200.

The electric power source 290 is composed of the electric power source unit 291 and an AC adapter 292. The electric power source unit 291 is connected to the AC adapter 292 and supplies electric power to each portion of the printing apparatus 1 by utilizing an AC electric power source supplied to the AC adapter 292.

The controlling portion 200 includes a CPU 210, a ROM 220, a RAM 240, and a peripheral control circuit (P-CON) 250. These devices are interconnected with one another by an internal bus 260.

A control program area 221 that stores a control program processed by the CPU 210 is provided in the ROM 220. Further, a register group 241, a buffer area 242 that temporarily stores the printing data sent from the computer 300 and synchronizes with the printing portion 12, are provided in the RAM 240.

A logic circuit that supplements the functions of the CPU 210 and handles an interface signal between the peripheral circuit is configured by a gate array, a custom LSI, or the like and incorporated in the P-CON 250. Further, a timer 251 that performs various clocking functions, is incorporated in the P-CON 250 as internal functions of the P-CON 250.

Further, the P-CON 250 is connected to various sensors of the detecting portion 15, and connected to the computer 300 by the USB cable 2 or the like, and the information detected by the detecting portion 15 and the printing data sent from the computer 300 are taken into the internal bus 260 as they are or after processing. Then, in cooperation with the CPU 210, the P-CON 250 outputs the data or the control signal, which is output from the CPU 210 or the like to the internal bus 260, to the driving portion 270 as it is or after processing.

Further, the CPU 210 performs control of the overall printing apparatus 1 by the configuration described above. Specifically, various types of detection signals, various types of commands, various types of data, and the like are acquired through the P-CON 250, according to the control program in the ROM 220. For example, the printing data such as a bitmap data transferred from the computer 300, various types of data in the RAM 240, and the like are processed and then a control signal is output to the driving portion 270 through the P-CON 250, thereby position control of the driving portion 270 for printing is executed, and the printing data is printed on the tape T.

Next, the operating portion 11 is described with reference to FIG. 5 to FIG. 16.

The operating portion 11 is structured by the general purpose computer 300 as described above. Further, in order to make the computer 300 function as the operating portion 11 of the printing apparatus 1, the application program for making the computer 300 function as the operating portion 11 is loaded into the computer 300 in this embodiment. As the application program is started, the computer 300 functions as the operating portion 11.

Figure 5:
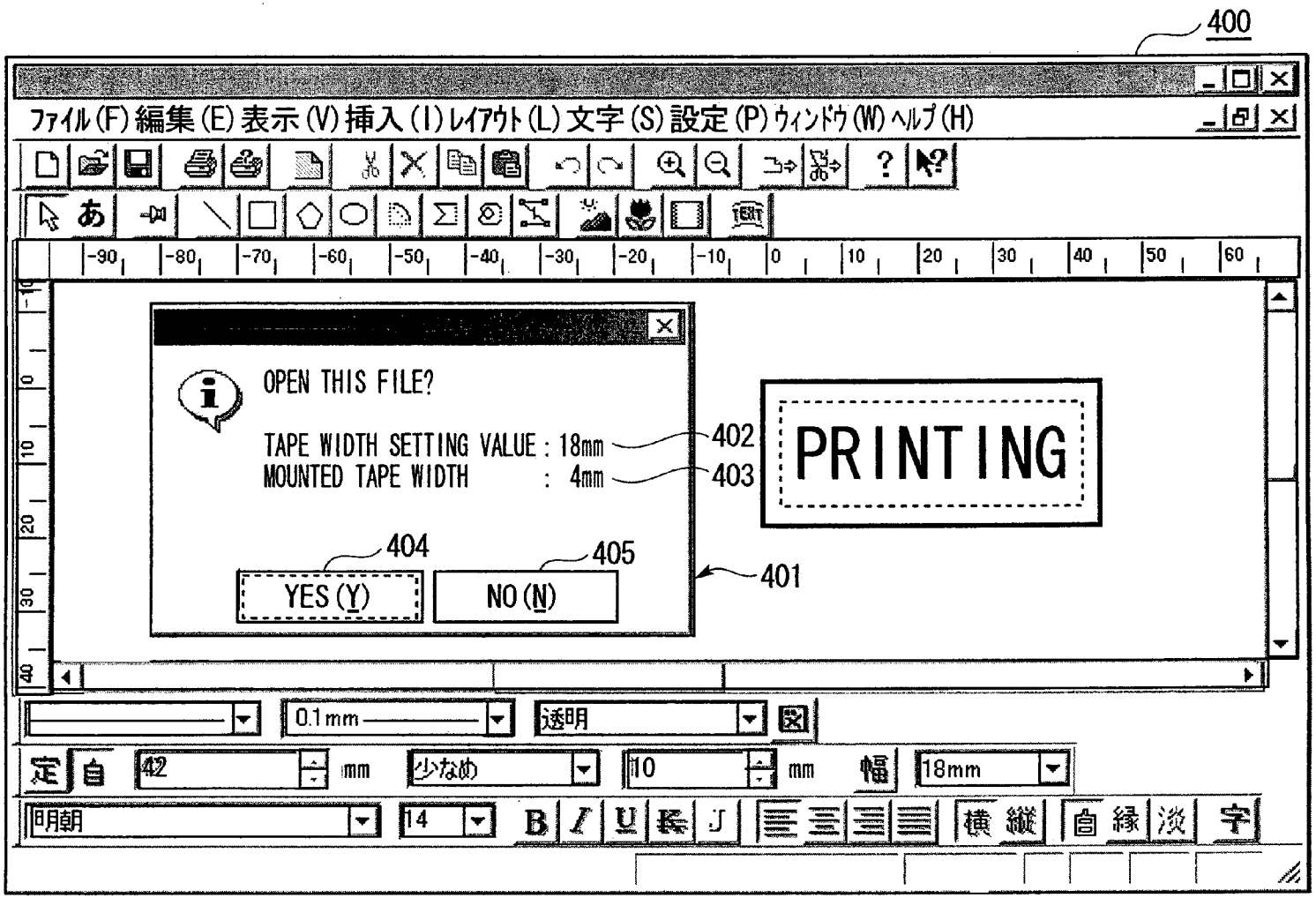
FIG. 5 is a schematic diagram of a tape information display screen according to the embodiment.

A setting selection screen (not shown) for selecting between new file creation and file selection is displayed in the display 306 of the computer 300 (the operating portion 11) upon start-up of the application program. When file selection is selected in the setting selection screen, for example, a tape information displaying screen 400 shown in FIG. 5 is displayed subsequently. It should be noted that the term file as used herein means the printing data that is stored within the large capacity memory device (printing data storing portion) 301. Various printing attribute data, including the editing tape width information such as a tape width setting value, is associated with the printing data and stored with the printing data.

A dialog box 401 that displays a mounted tape information (mounted tape width information) 403 showing the tape width of the tape T that is mounted in the printing apparatus 1, and an editing tape information (editing tape width information) 402, showing the tape width setting value read out from the selected file, is displayed in the tape information displaying screen 400. Further, icons 404 and 405, such as "yes" and "no", for verifying whether or not to reflect the editing tape information 402 read out from the file in subsequent editing work, are displayed in the dialog box 401.

Figure 6:
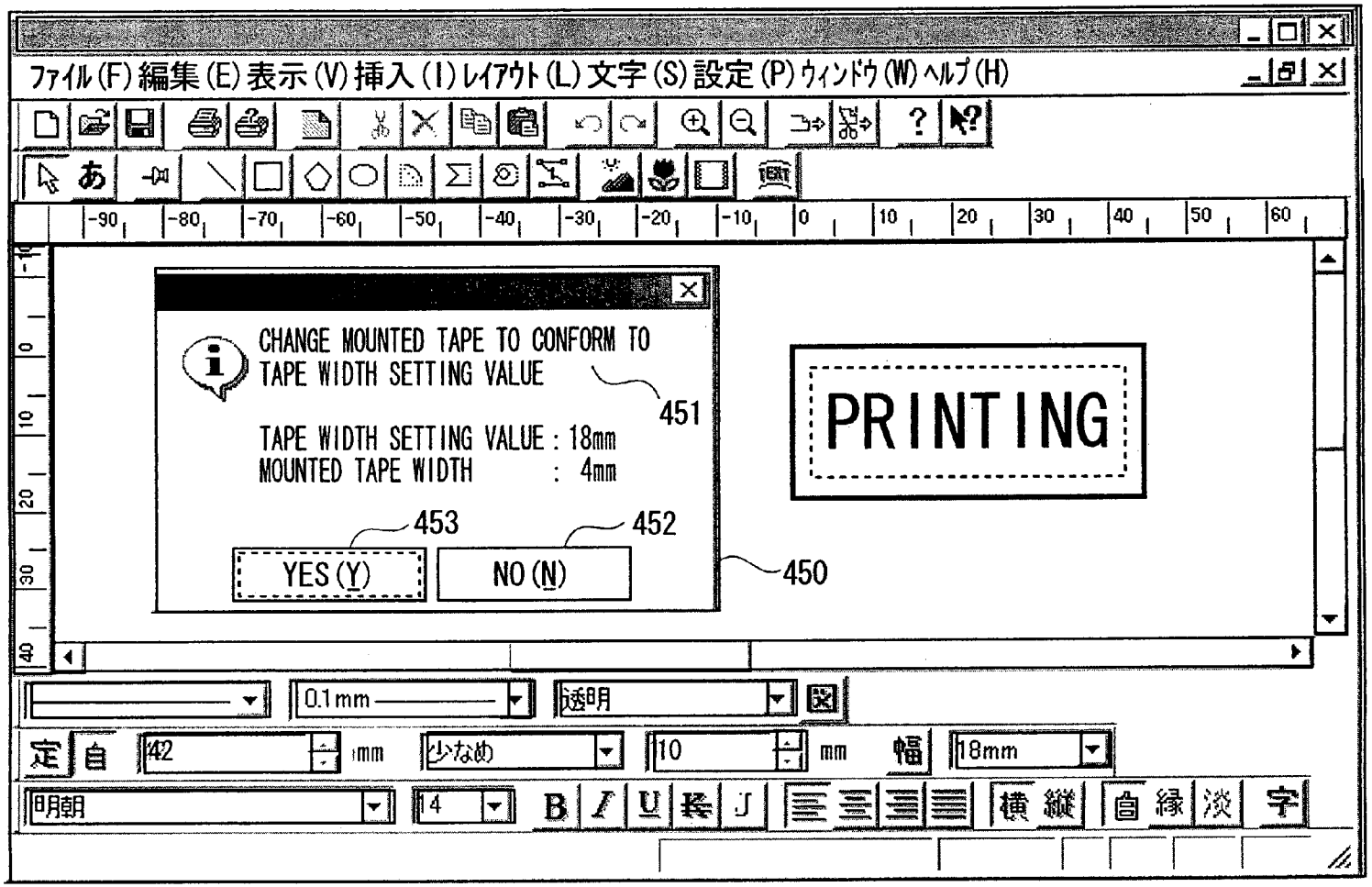
FIG. 6 is a schematic diagram of a dialog box used for verification of the mounted tape according to the embodiment.

When the "yes" icon 404 is operated based on a user's designation operation with the input device 307 such as a mouse, in order to have the settings (for example, tape width) of the selected editing tape information 402 read out from the file reflected in the subsequent editing work, a dialog box 450 used for verification of the mounted tape is displayed next in the display 306 based on the designation operation (see FIG. 6). Further, when the "no" icon 405 is operated, a new editing screen (not shown) is displayed on the display 306. It should be noted that, in the case where a new file, not the file selection, is selected upon start-up of the application program, the dialog box 450 similar to that of FIG. 6 may be displayed, and processing may be performed similarly to that of file selection described above. In this case, however, a default value (for example, 18 mm) is displayed as the tape width setting value instead of the tape width value associated with the file.

Next, an exchange verification message (exchange verification information) 451 requesting the user to exchange the tape cartridge C with a tape cartridge C that conforms to the tape width setting value set as the editing tape information, is displayed in the dialog box 450 for the mounted tape verification that is displayed after the "yes" icon 404 is operated in the dialog box 400 of FIG. 5, regardless of whether or not the editing tape information (editing tape width information) coincides with the mounted tape information (mounted tape width information). Further, icons 452 and 453, such as "yes" and "no", are displayed in the dialog box 450 for accepting a designation operation from the user as to whether or not to reflect the exchange/non-exchange of the tape cartridge C in the subsequent editing work.

When the tape cartridge is exchanged by the user and the "yes" icon 453 is operated by the user, each of the processes continues in subsequent editing work on the assumption that a new tape cartridge C in conformity with the editing tape information has been mounted.

It should be noted that the message requesting the user to exchange the tape cartridge C does not force the user to exchange the tape cartridge C, but it is only a message for making the user recognize differences between the editing tape information and the mounted tape information. Thus, it is possible to skip this process and to move to the next process even when operating the "no" icon 452.

Figure 7:
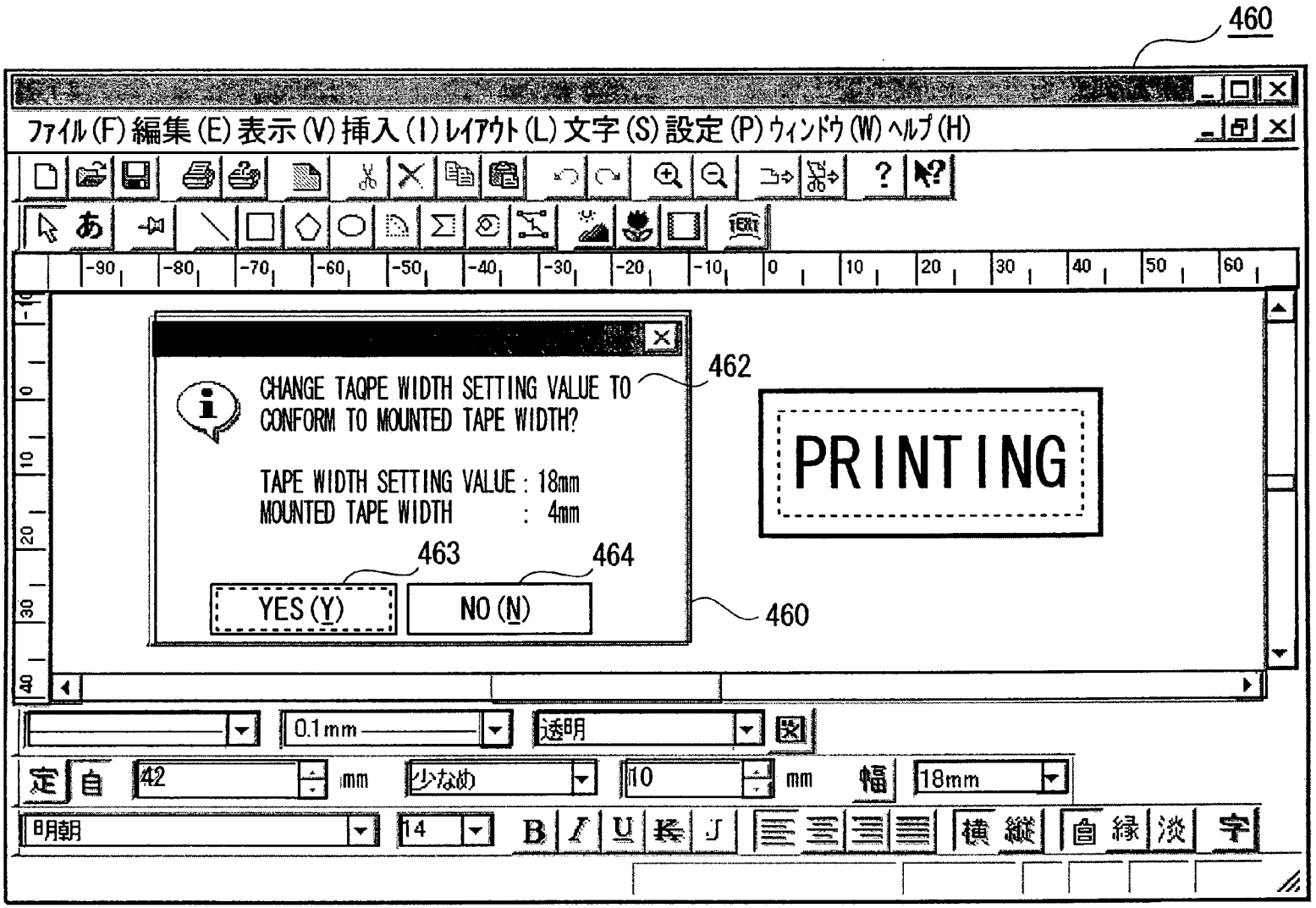
FIG. 7 is a schematic diagram of a dialog box used for verification of setting according to the embodiment.

Further, when the "no" icon 452 described above is operated, a dialog box 460 used for verification of setting is displayed in the display 306 (see FIG. 7).

A setting verification message (setting verification information) 462 for requesting the user to verify whether or not to change the tape width setting value, which is set as the editing tape information and reflected in the printing data, to conform to the width of the tape T in the cartridge C mounted in the printing apparatus 1 (hereinafter referred to simply as the mounted tape width) is displayed in the dialog box 460 used for the setting verification. Further, icons 463 and 464, such as "yes" and "no", are displayed for accepting the operation for reflecting the presence/absence of a change in the tape width setting value in the subsequent processes.

For example, the tape width setting value is updated to a value that corresponds to the mounted tape width, when a designation operation is given by the user on the "yes" icon 463 in the dialog box 460 used for the setting verification, which requires the computer 300 to change the tape width setting value. Furthermore, when the "no" icon 464 is operated in the dialog box 450 used for the setting verification, the existing tape width setting value is maintained, and processing moves to the next process. It should be noted that it is also possible to display, for example, a dialog box (not shown) for displaying a re-verification message such as "Edit as it is?" By displaying this dialog box, it is possible to make the user re-verify the setting contents.

Figure 8:
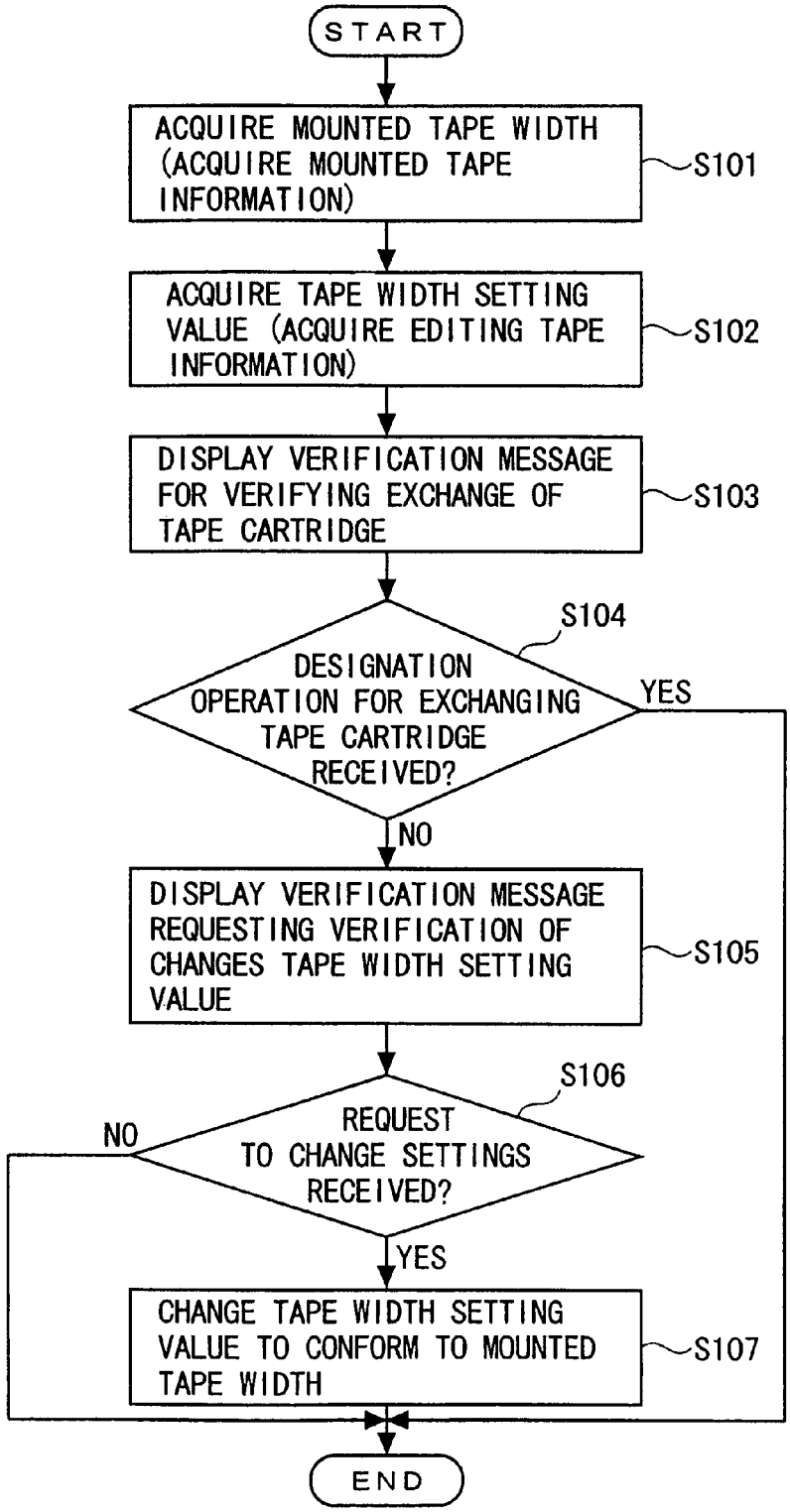
FIG. 8 is a flowchart that shows a series of controls for controlling the display of the dialog box used for verification of the mounted tape and the dialog box used for verification of setting.

It should be noted that FIG. 8 is a flowchart that shows a series of controls relating to display control of the dialog box 450 used for the mounted tape verification and the dialog box 460 used for the setting verification. Each display control is described hereinafter with reference to this flowchart.

First, in displaying the dialog box 450 used for the mounted tape verification, the CPU 302 provided in the operating portion 11 acquires the tape width of the tape cartridge C mounted in the printing apparatus 1, that is, the mounted tape width, from the RAM 304 that stores the mounted tape information acquired from the tape identification sensor 142 of the printing apparatus 1 (S101).

Subsequently, the CPU 302 reads-in the editing tape information selected through the setting selection screen from the RAM 304, and acquires the tape width setting value that is to be reflected in editing of the printing data (S102).

The dialog box 450 used for the mounted tape verification, which shows the mounted tape width and the tape setting value, as well as exchange of the tape cartridge C with one that is in conformity with the tape setting value, is displayed in the display 306 (S103). Further, the presence/absence of the change of the tape cartridge C by the user is accepted in the dialog box 450 used for the mounted tape verification by the designation operations on the icons 452 and 453 displayed in the dialog box 450 used for the mounted tape verification (S104).

When a designation operation indicating exchange of the tape cartridge C is accepted (YES in S104), the processing temporarily leaves this processing routine and moves to the editing work processing. Further, when a designation operation for using the mounted tape cartridge C as it is accepted (NO in S104), the processing moves to the subsequent step 105 to display the dialog box 460 used for the setting verification.

In step 105, the dialog box 460 used for the setting verification is displayed, which shows the previously acquired mounted tape width and the tape setting value, and which requests verification as to whether or not to change the tape width setting value to conform to the mounted tape width (S105).

Further, in the case where there is a user's designation operation that requests a change in the tape width setting value (YES in S106) in the dialog box 460 used for the setting verification, the tape width setting value is updated to a value that corresponds to the mounted tape width (S107). Further, in the case where there is a user's designation operation that requests continued use of the existing tape width setting value (NO in S106), this processing routine is temporarily terminated without updating the existing tape width setting value, and subsequently the processing moves to the editing work processing.

It should be noted that, although a detailed description is provided in the embodiment described above with respect to the processing executed when file selection is performed upon start-up of the application program, the present invention is not limited to this. For example, the processing of the flowchart shown in FIG. 8 is similarly performed in displaying each of the dialog boxes of FIG. 6 and FIG. 7 in the case where amounted tape width information acquisition icon 503, which will be described later, is operated after exchanging the tape mounted in the printing apparatus 1 during editing work prior to the commencement of printing and the mounted tape width information is then acquired again, and in the case where a value is input to change an editing tape width setting column 502 in order to change the editing tape width, which will be described later. It should be noted that the mounted tape width information acquisition icon 503 and the editing tape width setting column 502 will be described later with reference to FIG. 9.

Figure 9:
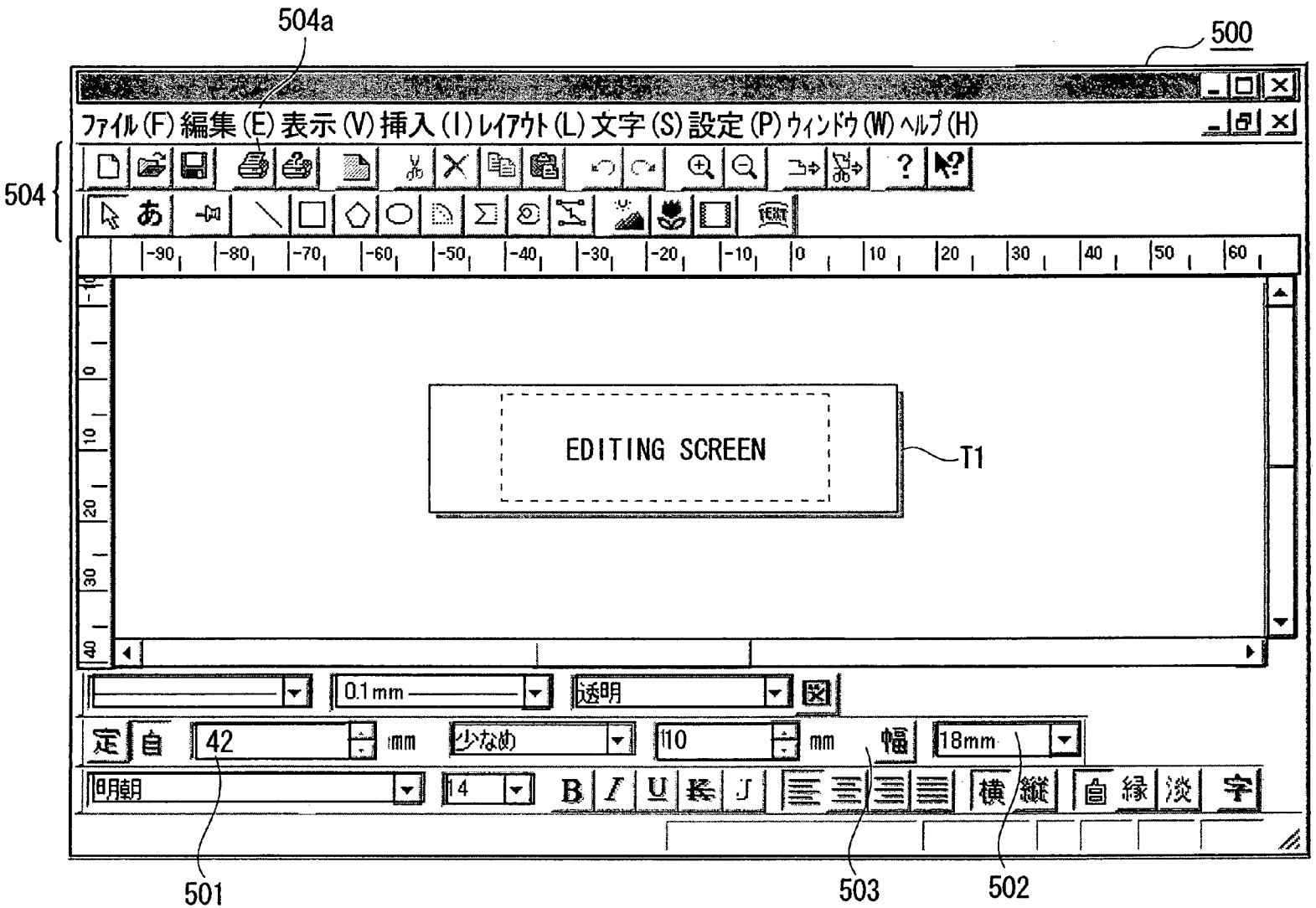
FIG. 9 is a schematic diagram of an editing screen according to the embodiment.

Next, an editing screen 500 that is displayed at the time of editing the printing data is described with reference to FIG. 9. It should be noted that the editing screen 500 is a screen that is displayed in the display 306 following commencement of the editing work processes described above.

An image T1 of the tape T, having a tape width value that is equal to the tape width value set as the editing tape information to be reflected in the printing data, is displayed in the editing screen 500. It then becomes possible to edit the printing data (characters, for example), with the tape image T1 taken as a base surface. It should be noted that, in addition to the tape width setting value read out from the file and the tape width setting value updated to conform to the mounted tape width, the tape width setting value set as the editing tape information also includes the default tape width setting value set for a new file creation, and the like.

Further, the editing work using the tape image T1 is described in detail. Characters or the like that are input by using the keyboard 307 are displayed as synthesized on the image T1 on the editing screen 500. The user edits the printing data while verifying the layout, content, and the like by comparing the image T1 with the input characters and the like.

Further, a tape length setting column 501 for setting the tape length that is reflected in the printing data and the tape width setting column 502 for setting the tape width that is reflected in the printing data are provided at the lower portion of the editing screen 500. When editing the printing data, numerical values input to, or selected in, the setting columns 501 and 502 are reflected in the printing data, and printing is performed according to this dimension setting. That is, the input to, or the selection of, numerical values in the setting columns 501 and 502 is reflected in the dimension settings of the editing tape information that is edited when editing the printing data. Further, the tape width acquisition operation icon 503 for acquiring, at any selected time, the tape width information of the tape cartridge C that is mounted in the printing apparatus 1, is provided to the left of the tape width setting column 502.

Further, an icon group 504 for instructing the CPU 302 to save the printing data or to perform printing is provided in the upper portion of the editing screen 500. The subsequent control processes are performed according to the designation when operating these icons.

Figure 10:
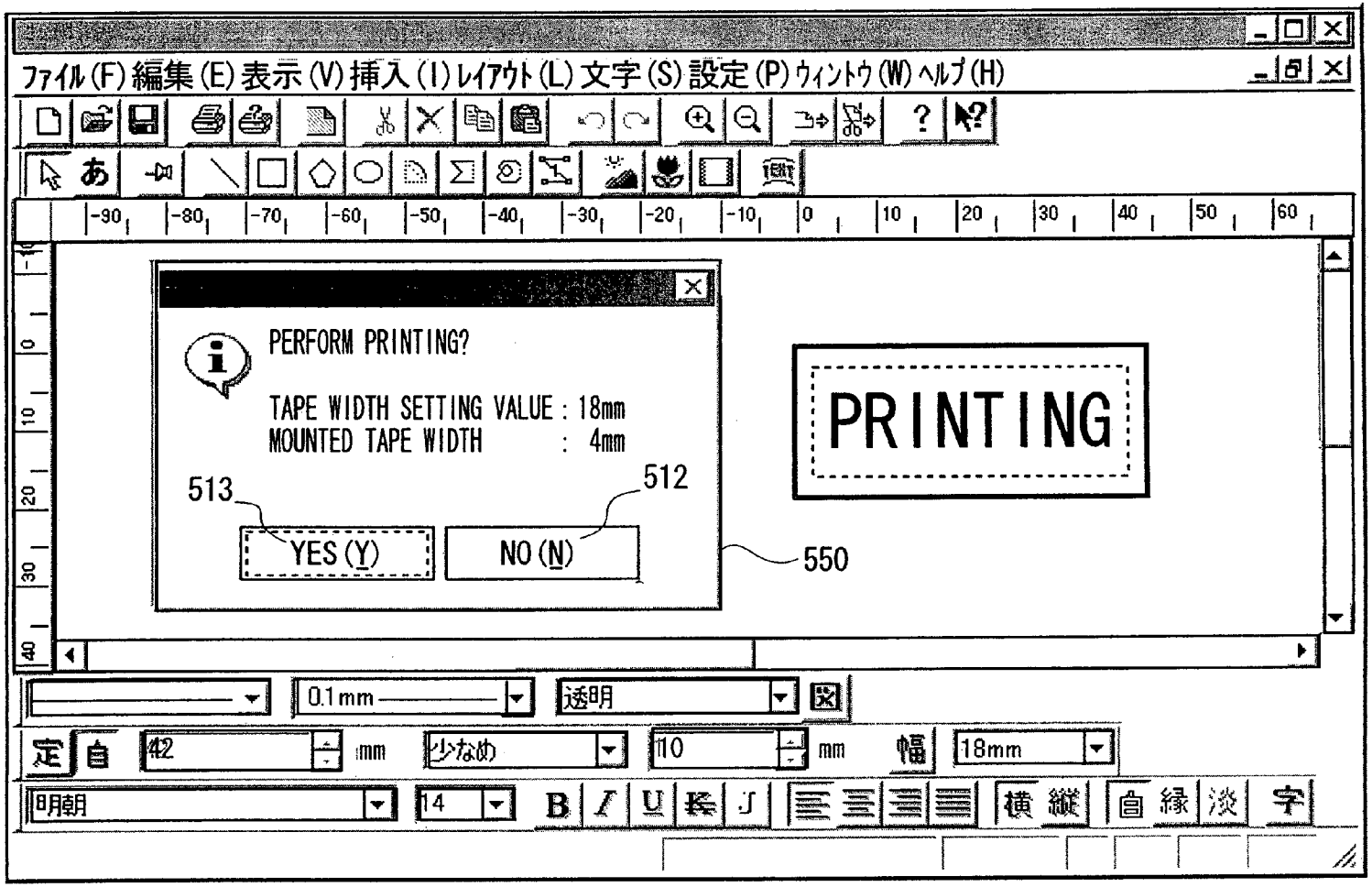
FIG. 10 is a schematic diagram of a dialog box used for verifying printing operations according to the embodiment.

Further, in the editing screen 500, when an icon 504*a* for instructing the printing is operated, the dialog 550 used for verifying printing operations showing the mounted tape information, and in addition, the tape width setting value that is set as the editing tape information to be reflected in the printing data, is displayed in the display 306 at any selected timing before printing commences (refer to FIG. 10).

Further, the CPU 302 waits for the printing data to be sent to the printing apparatus 1 during this period, and in the dialog 550 for verification, an execution of printing or cancellation of the printing designation is accepted through operation on icon 513 or 512, such as "yes" or "no", relating to printing, which is displayed together with the mounted tape width, the tape width setting value, and the like.

Figure 11:
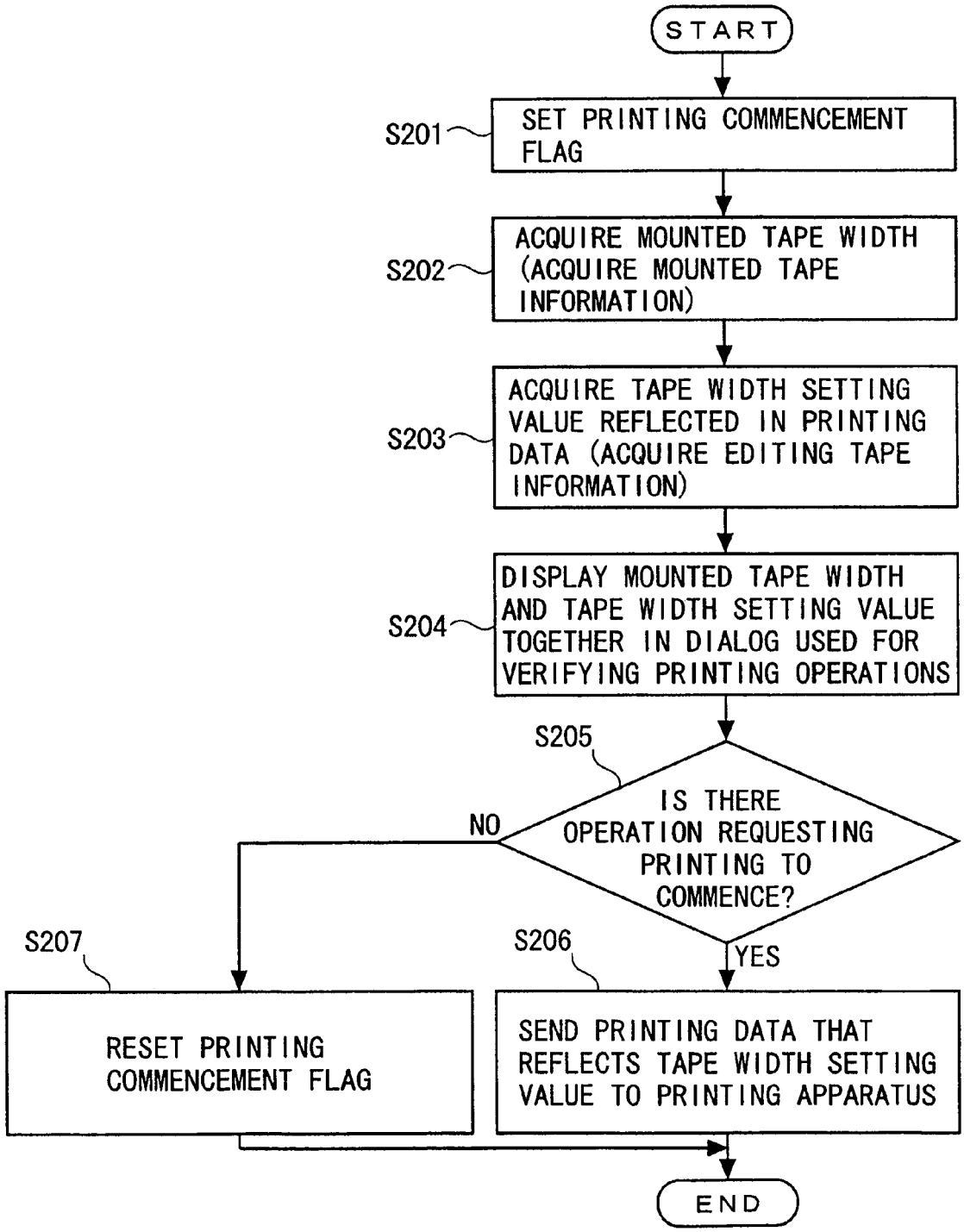
FIG. 11 is a flowchart that shows a series of controls relating to control of the display of the dialog box used for verifying printing operations according to the embodiment.

Display control of the dialog 550 used for verification of printing operations is described explained below with reference to a flowchart of FIG. 11.

First, upon operation of the icon 504*a*, the CPU 302 sets a flag indicating commencement of printing in the processing area of the RAM 304 allocated to display control processing (S201).

Subsequently, the CPU 302 acquires the mounted tape information of the tape cartridge C that is mounted in the printing apparatus 1, that is, the mounted tape width, from the RAM 304, which stores the mounted tape width acquired by the tape identification sensor 142 of the printing apparatus 1 (S202).

Further, the CPU 302 acquires the tape width setting value that is set in order to be reflected in the printing data, for example, by referring to the numerical value set in the tape width setting column 502 (S203). The acquired tape information is then incorporated into the dialog 550 used for verifying printing operations, and is output such that the user can recognize the tape information through the display 306 (S204).

Further, the icons 513 and 512, such as "yes" and "no", for verifying whether or not to perform printing, are displayed in the dialog 550 used for verifying printing operations, and the CPU 302 accepts designation operations with a mouse or the like directed to the icons 513 and 512 as objects (S205). The printing data, in which the edited tape width setting value is reflected, is then sent to the printing apparatus 1 following a designation operation of the icon 513 that instructs printing to commence (S206). Accordingly, the printing data, in which the tape width setting value is reflected, is printed on the tape T. Further, when the "no" icon 512 is operated, the printing commencement flag is reset (S207), and printing processing finishes without the commencement of printing.

When executing the application program for controlling the printing apparatus 1, the mounted tape width (mounted tape information) acquired by the tape identifying sensor 142, and the tape width setting value (editing tape information) that is edited when editing the printing data are thus output at any selected timing before printing commences, regardless of whether or not they coincide with each other. Further, after outputting the information on these tape widths, a designation operation by the user for performing printing that reflects the tape width setting value, or for canceling the printing designation, is accepted, and whether or not to perform printing that reflects the editing tape information is determined by this designation operation.

That is, before printing commences, the user can grasp the width of the tape that is mounted in the printing apparatus 1 coincides with the width of the tape to be edited and reflected in the printing data, regardless of whether or not they coincide with each other. Accordingly, even users who are unaccustomed to the operations can easily grasp whether or not a suitable printing processing is to be performed. Further, whether or not the printing process is suitable can be determined based on the recognized tape width, thereby the printing using an erroneous tape cartridge C can be prevented also in this respect. Thus, with the printing apparatus 1, the user's intentions can be easily and accurately reflected in control of the printing apparatus 1, without the need of complex operations.

It should be noted that the embodiment described above is only one example. It is possible to make various changes to the details of the embodiment to conform to the specifications of the printing apparatus 1 and the like.

Further, while the application program suitably displays the mounted tape width, the tape width setting value, and the like for optimizing each process, the functions of the application program are not limited to the functions described above, and it is possible to make various changed to the application program when necessary.

Figure 12:
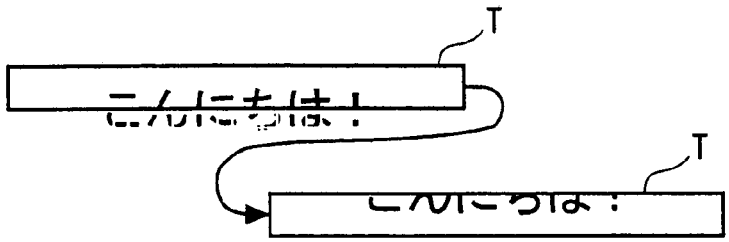
FIG. 12 is a diagram that shows a printing state in a case where a tape width setting value reflected in the printing data is large compared to the width of a mounted tape.

One example of a change to the application program is explained. For instance, as shown in FIG. 12, it may be configured such that the printing data (characters, for example) are divided in the width direction of the tape T in the case where the tape width setting value is large compared to the mounted tape width, and the divided printing data are printed while aligned in the longitudinal direction of the tape T.

More specifically, the value of the mounted tape width (mounted tape width information) is taken as A, and the tape width setting value (editing tape width information) is taken as B, and in the case where a relationship $B=n\times A$ (where n is an integer equal to or greater than 2) can be established, the printing data is divided into n divisions in the width direction of the printing data, and the n number of printing data divisions are printed on the tape T with respect to the width A while aligned in the longitudinal direction of the tape T. Accordingly, when the user cuts the tape T with the width A at suitable locations, and lines up the cut portions in the width direction of the tape T, it forms a pseudo tape of the width B, then, the printing data is displayed in the correct size on the tape with the width B.

Figure 13:
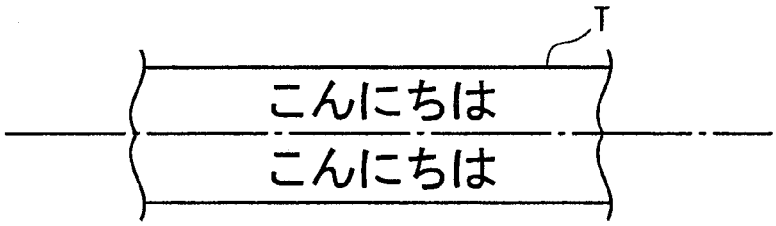
FIG. 13 is a diagram that shows a printing state in a case where a tape width setting value reflected in the printing data is small compared to the width of a mounted tape.

Conversely, in the case where the tape width setting value reflected in the printing data is small compared to the mounted tape width, it may be configured, for example, as shown in FIG. 13, wherein the printing data may be lined up in a plurality of columns in the width direction of the tape T mounted in the printing apparatus 1 for printing.

More specifically, the value of the mounted tape width (mounted tape width information) is taken as A, and the tape setting value (mounted tape width information) is taken as B, and in the case where a relationship $A=n\times B$ (where n is an integer equal to or greater than 2) is established, a configuration may be employed in which the printing data is lined up in n number of columns in the width direction of the tape mounted in the printing apparatus 1 for printing.

Figure 14:
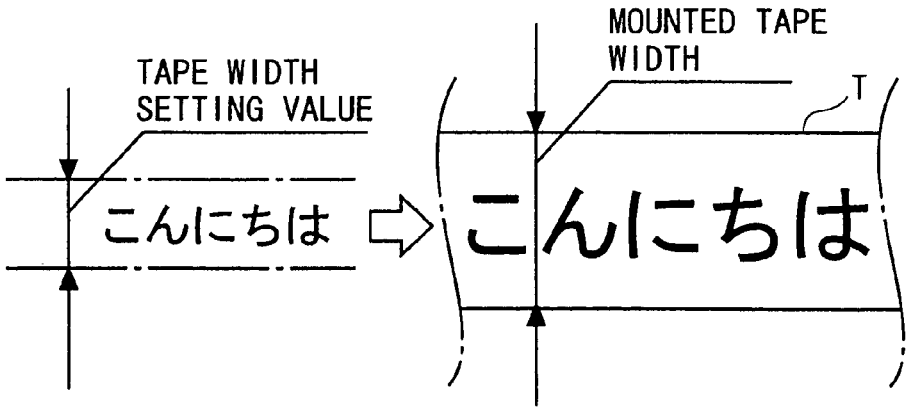
FIG. 14 is a diagram that shows a printing state during enlarged printing.

Further, as shown in FIG. 14, a function for enlarging and reducing the size of the printing data may also be provided so that the printing data is printed while enlarged or reduced to conform to the actually mounted tape width.

Furthermore, in editing the tape width setting value, a configuration can also be considered in which the tape width setting value is changed by processing on the screen, by, for instance, designating the edges of the image T1 by using a mouse, thereby the image T1 may be enlarged or reduced by drag-and-drop. It should be noted that, in this case as well, regardless of whether or not the enlarged or reduced tape width setting value coincides with the mounted tape width, the information of these tape widths is displayed in the editing screen 500. It may be configured that along with the tape information, a message for verifying whether or not to change the tape width setting value may also be displayed.

Further, a configuration may also be considered in which an image captured by a digital camera is taken into the computer 300, and this image data is synthesized on the base surface of the image T1 of the tape T, and reflected in the printing data. Further, a configuration may be employed in which an object to be attached to the tape T and which is photographed by a digital camera can be synthesized for display in a background of the editing screen 500. With this configuration it becomes possible to perform editing in the editing screen 500 while imaging a state where the tape T is affixed to the object to be attached to the tape.

Figure 15:
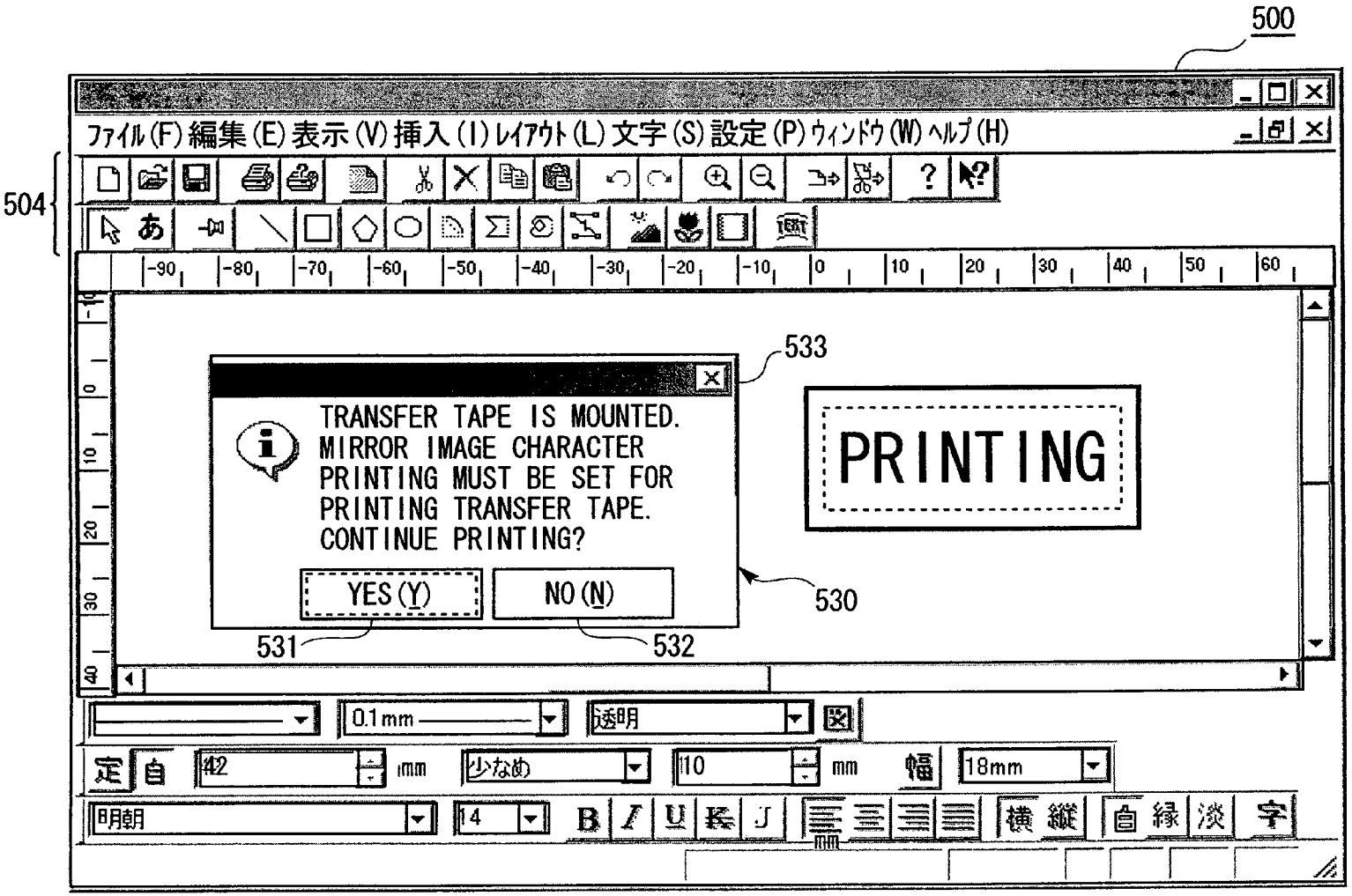
FIG. 15 is a schematic diagram of a dialog box that is displayed when a transfer tape cartridge is mounted.

Display control in the case where a transfer tape cartridge Ct is mounted in the printing apparatus 1 is described with reference to FIG. 15.

When the icon 504*a* for printing is operated in a state where the transfer tape cartridge Ct is mounted, the CPU 302 displays a dialog box 530, in which a message is shown indicating that the transfer tape cartridge Ct is mounted, in the editing screen 500. Further, a message 533 that requests a designation for mirror image character printing, a message for verifying the continuation of printing, and icons 531 and 532 for accepting whether or not to perform printing are displayed in the dialog box 530.

It should be noted that the dialog box 530 is displayed when the transfer tape cartridge Ct is mounted, irrespective of whether or not the mirror image character printing is designated. That is, the dialog box 530 is displayed when the transfer tape cartridge Ct is mounted in the printing apparatus 1, irrespective of whether or not mirror image printing is designated. Further, a configuration can of course be used in which display is performed not only in the editing screen 500 but also in the tape information display screen 400 described above.

Figure 16:
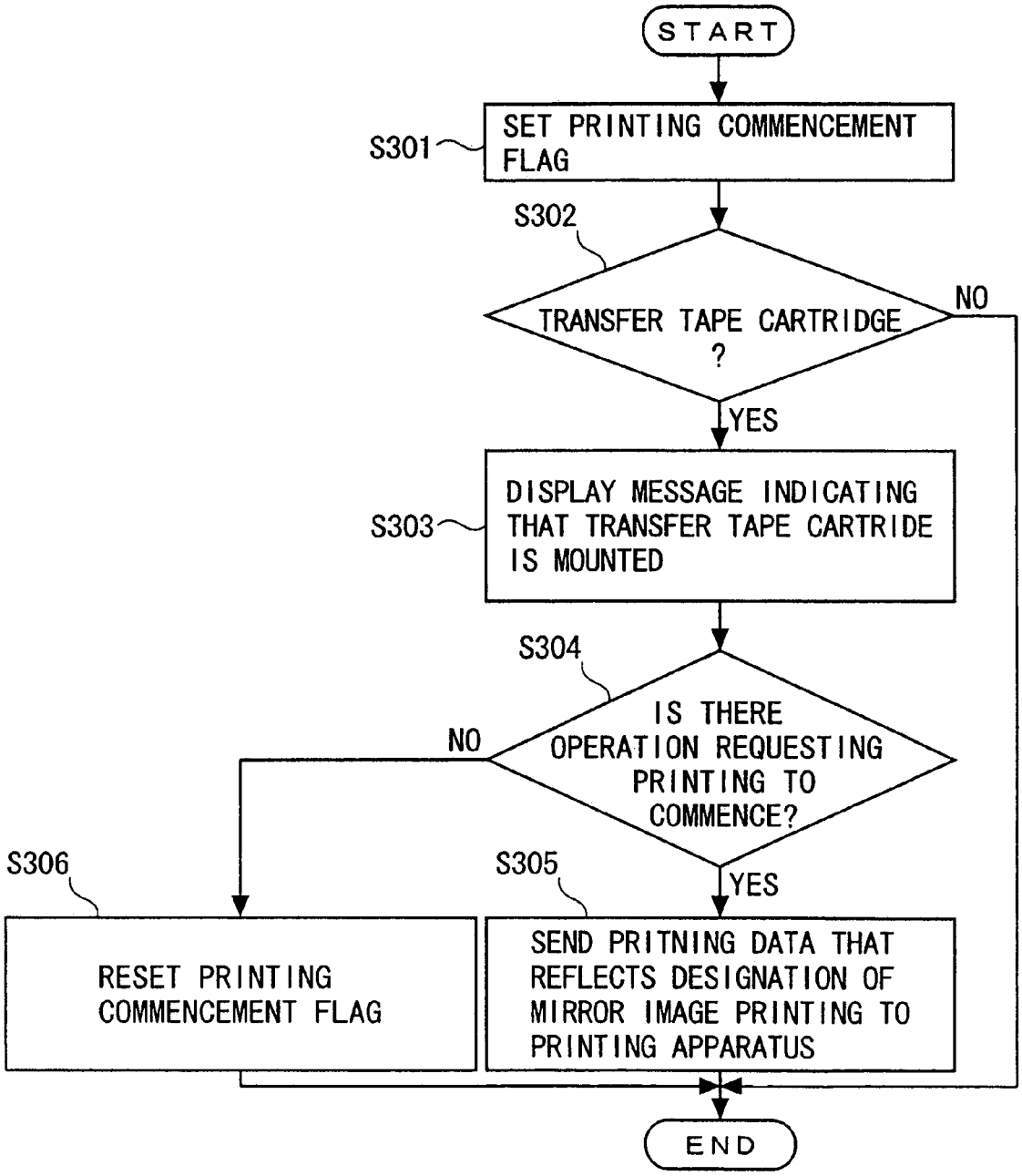
FIG. 16 is a flowchart that shows a series of controls relating to display of the dialog box that is displayed when the transfer tape cartridge is mounted.

Display control for the dialog box 530 is described below with reference to a flowchart of FIG. 16.

First, with the operation of the icon 504*a* used for designating printing the CPU 302 sets a flag, which indicates commencement of printing, in the processing area of the RAM 304 that is allocated to display control processing (S301).

Next, the CPU 302 reads in the output of the tape identifying sensor 142 that is provided in the printing apparatus 1, and detects whether or not the transfer tape cartridge Ct is mounted in the printing apparatus 1 (S302).

Further, in the case where the transfer tape cartridge Ct is mounted (YES in S302), this fact is displayed in the display 306 via the dialog box 530 (S303). Further, designation of whether or not to commence printing is accepted by operations of the icons 531 and 532 that are displayed in the same dialog box 530 (S304) When the icon 531 that designates commencing the printing is operated, the printing data that reflects the designation for mirror image printing is sent to the printing apparatus 1 (S305). Further, when the icon 532 for canceling printing is operated, the flag indicating printing commencement is reset (S306) and the processing finishes.

Thus, when the above application program is executed, in the case where the transfer tape cartridge is mounted in the printing apparatus 1, this fact is displayed as the tape information of the transfer tape cartridge, regardless of whether or not the mirror image character printing is designated. Accordingly, the printing corresponding to transfer can be performed by designating the mirror image printing upon receipt of the message display, even if the mirror image character printing is not set in advance.

It should be noted that, for convenience of editing, editing of the printing data corresponding to the mirror image printing is similar to editing of the printing data corresponding to the non-mirror image printing. Accordingly, it is also possible to make changes such as employing configurations for displaying an inverted image, which corresponds to the mirror image printing, on the editing screen 500 in order to provide an image of the mirror image printing to the user.

Figure 17:
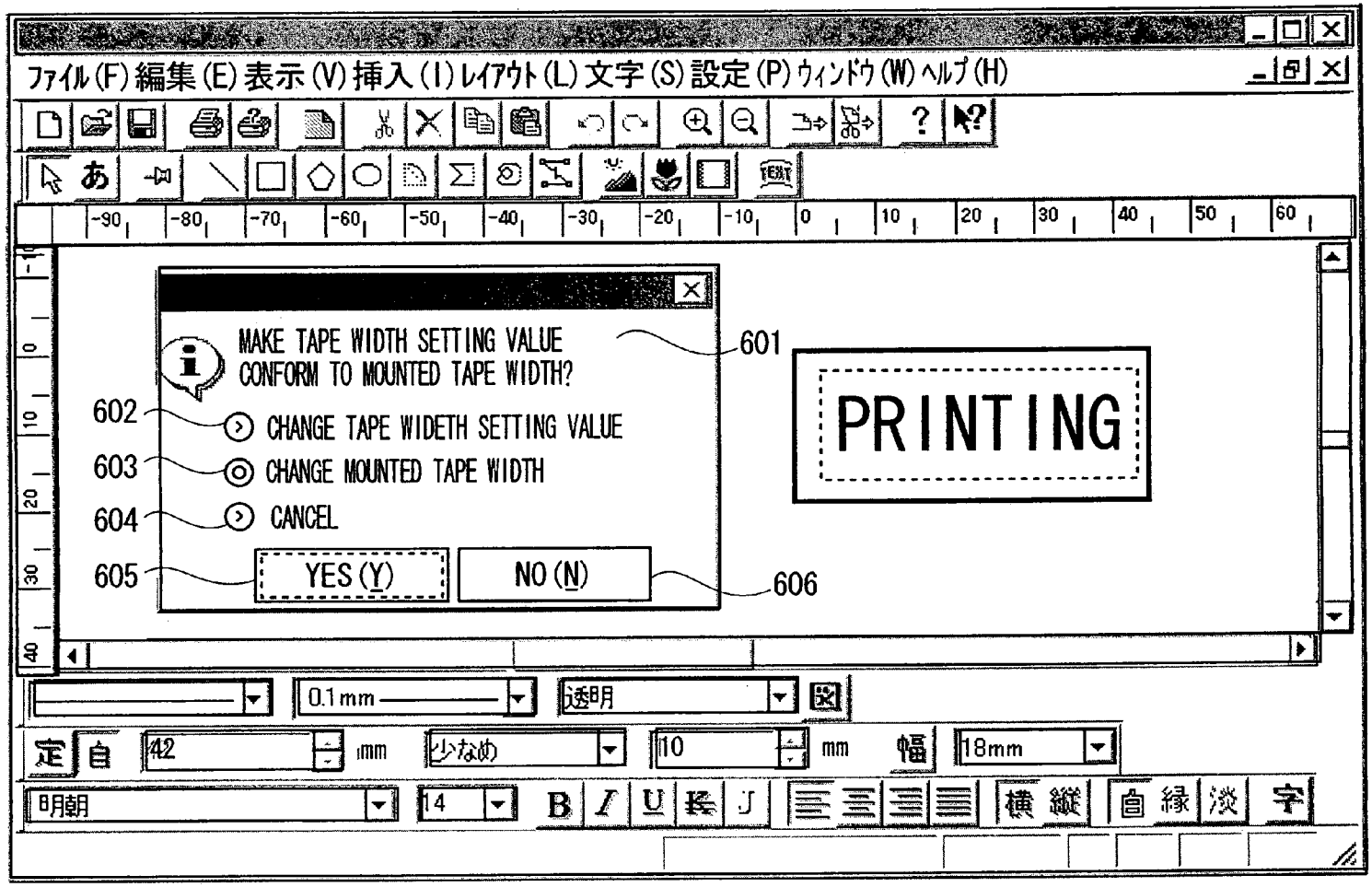
FIG. 17 is a schematic diagram that shows a state where an alteration verification information and a setting verification information are displayed in an editing screen in a wizard format according to the embodiment.

Furthermore, although dialog boxes having different types of information are displayed in this embodiment when displaying the setting verification message 462 and the exchange verification message 451, it is also possible to output this information in a wizard format shown in FIG. 17. In this case, a message 601 asking the user whether or not the tape width setting value is adapted to conform to the mounted tape width, and icons 602, 603, and 604 that correspond to alternatives such as "change tape width setting value", "change mounted tape width", and "cancel", are displayed. An item to be changed may be selected by operating the icons corresponding to these alternatives. In addition, the existence of an item to be changed can be reflected in each control by operating icons 605 and 606, used for confirmation or cancellation, respectively, that are provided below the icons 602 to 604.

It is thus possible to make various changes to this embodiment.

According to the present invention, a printing apparatus can be provided in which a user can verify the tape information at any selected time, including immediately before printing, regardless of whether or not there is coincidence between tape information. Printing processes can thus be optimized, and the printing that is contrary to the intentions of the user, such as cartridge mounting mistakes, can be prevented.

What is claimed is:

1. A printing apparatus for printing a printing data on a tape, comprising:

a mounted tape information acquiring portion for acquiring mounted tape information including at least one of mounted tape width information relating to a tape mounted in the printing apparatus and mounted tape type information relating to a tape mounted in the printing apparatus;

an editing tape information setting portion for setting editing tape information including at least one of editing tape width information to be edited and editing tape type information to be edited at the time of editing the printing data;

a tape information outputting portion for outputting the mounted tape information and the editing tape information simultaneously in a state to be recognized by a user before printing commences; and designation operation accepting means that, after the tape information is output, accepts a user's designation operation for either execution of printing that reflects the editing tape information or cancellation of the printing designation.

2. A printing apparatus for printing a printing data on a tape, comprising:

a mounted tape information acquiring portion for acquiring a mounted tape information relating to a tape mounted in the printing apparatus;

an editing tape information setting portion for setting an editing tape information to be edited at the time of editing the printing data;

a tape information outputting portion for outputting the mounted tape information and the editing tape information in a state to be recognized by a user; and a replacement verification information outputting portion that, after the tape information is output, outputs in the state to be recognized by the user a replacement verification information for requesting the user for verification of whether or not to replace the tape in the printing apparatus according to the editing tape information.

3. A printing apparatus according to claim 2, further comprising:

a printing data storing portion for storing the printing data together with the editing tape information associated with the printing data; and a printing data read-out portion for reading out the printing data taken as an editing object from the printing data storing portion and the editing tape information associated with the printing data, wherein:

the tape information outputting portion outputs the tape information in the state to be recognized by the user when the printing data read-out portion reads out a selected printing data, from among the printing data stored in the printing data storing portion, as the editing object.

4. A printing apparatus according to claim 2, further comprising:

a mounted tape information reacquiring portion for acquiring a mounted tape information relating to a newly mounted tape when the tape mounted in the printing apparatus is replaced, wherein:

the tape information outputting portion outputs the mounted tape information relating to the newly mounted tape as the tape information in the state to be recognized by the user when the mounted tape information reacquiring portion acquires the mounted tape information relating to the newly mounted tape.

5. A printing apparatus for printing a printing data on a tape, comprising:

a mounted tape information acquiring portion for acquiring mounted tape information including at least one of mounted tape width information relating to a tape mounted in the printing apparatus and mounted tape type information relating to a tape mounted in the printing apparatus;

an editing tape information setting portion for setting editing tape information including at least one of editing tape width information to be edited and editing tape type information to be edited at the time of editing the printing data;

a tape information outputting portion for outputting the mounted tape information and the editing tape information simultaneously in a state to be recognized by a user; and an altering verification information outputting portion that, after the tape information is output, outputs in the state to be recognized by the user altering verification information for requesting the user for verification of whether or not to alter the editing tape information according to the mounted tape information.

6. A printing apparatus according to claim 5, further comprising:

a printing data storing portion for storing the printing data together with the editing tape information associated with the printing data; and a printing data read-out portion for reading out the printing data taken as an editing object from the printing data storing portion and the editing tape information associated with the printing data, wherein:

the tape information outputting portion outputs the tape information in the state to be recognized by the user when the printing data read-out portion reads out a selected printing data, from among the printing data stored in the printing data storing portion, as the editing object.

7. A printing apparatus according to claim 5, further comprising:

an editing tape information altering portion for altering the editing tape information to be edited at the time of editing the printing data.

8. A printing method for printing a printing data on a tape, comprising:

acquiring mounted tape information including at least one of mounted tape width information relating to a tape mounted in the printing apparatus and mounted tape type information relating to a tape mounted in a printing apparatus and editing tape information including at least one of editing tape width information to be edited and editing tape type information to be edited at the time of editing the printing data;

outputting the acquired mounted tape information and the editing tape information simultaneously in a state to be recognized by a user before printing commences; and after the tape information is output, accepting a user's designation operation for either execution of the printing that reflects the editing tape information or cancellation of the printing designation.

9. A printing method for printing a printing data on a tape comprising:

acquiring a mounted tape information relating to a tape mounted in a printing apparatus and an editing tape information to be edited at the time of editing the printing data;

outputting the acquired mounted tape information and the editing tape information in a state to be recognized by a user; and after the tape information is output, requesting the user for verification of whether or not to replace the tape in the printing apparatus according to the editing tape information.

10. A printing method according to claim 9, further comprising:

storing the printing data together with the editing tape information associated with the printing data; and outputting the tape information in the state to be recognized by the user when any selected printing data, from among the stored printing data, and the editing tape information associated with the printing data, are read out as an editing object.

11. A printing method according to claim 9, further comprising:

acquiring a mounted tape information relating to a newly mounted tape when the tape mounted in the printing apparatus is replaced; and outputting the mounted tape information relating to the newly mounted tape in the state to be recognized by the user.

12. A printing method for printing a printing data on a tape, comprising:

acquiring mounted tape information including at least one of mounted tape width information relating to a tape mounted in the printing apparatus and mounted tape type information relating to a tape mounted in a printing apparatus and editing tape information including at least one of editing tape width information to be edited and editing tape type information to be edited at the time of editing the printing data;

outputting the acquired mounted tape information and the editing tape information simultaneously in a state to be recognized by a user; and after the tape information is output, requesting the user for verification of whether or not to alter the editing tape information according to the mounted tape information.

13. A printing method according to claim 12, further comprising:

storing the printing data together with the editing tape information associated with the printing data; and outputting the tape information in the state to be recognized by the user when any selected printing data, from among the stored printing data, and the editing tape information associated with the printing data, are read out as an editing object.

14. A program for a control device for controlling a printing apparatus for printing a printing data on a tape, the program causing the control device to implement:

a mounted tape information acquiring function for acquiring mounted tape information including at least one of mounted tape width information relating to a tape mounted in the printing apparatus and mounted tape type information relating to a tape mounted in the printing apparatus;

an editing tape information setting function for setting editing tape information including at least one of editing tape width information to be edited and editing tape type information to be edited at the time of editing the printing data;

a tape information outputting function for outputting the mounted tape information and the editing tape information simultaneously in a state to be recognized by a user before printing commences; and a designation operation accepting function that, after the tape information is output, accepts a user's designation operation for either execution of printing that reflects the editing tape information or cancellation of the printing designation.

15. A program for a control device that controlling a printing apparatus for printing a printing data on a tape, the program causing the control device to implement:

a mounted tape information acquiring function for acquiring a mounted tape information relating to a tape mounted in the printing apparatus;

an editing tape information setting function for setting an editing tape information to be edited at the time of editing the printing data;

a tape information outputting function for outputting the mounted tape information and the editing tape information in a state to be recognized by a user; and a replacement verification information outputting function that, after the tape information is output, outputs in the state to be recognized by the user a replacement verification information for requesting the user for verification of whether or not to replace the tape in the printing apparatus according to the editing tape information.

16. A program for a control device for controlling a printing apparatus for printing a printing data on a tape, the program causing the control device to implement:

a mounted tape information acquiring function for acquiring mounted tape information including at least one of mounted tape width information relating to a tape mounted in the printing apparatus and mounted tape type information relating to a tape mounted in the printing apparatus;

an editing tape information setting function for setting editing tape information including at least one of editing tape width information to be edited and editing tape type information to be edited at the time of editing the printing data;

a tape information outputting function for outputting the mounted tape information and the editing tape information simultaneously in a state to be recognized by a user; and an altering verification information outputting function that, after the tape information is output, outputs in the state to be recognized by the user altering verification information for requesting the user for verification of whether or not to alter the editing tape information according to the mounted tape information.

* * * * *